US009644291B1

(12) United States Patent
Kuo

(10) Patent No.: US 9,644,291 B1
(45) Date of Patent: May 9, 2017

(54) DOUBLE-SIDED FABRIC EMBEDDED WITH CONTINUOUS LINEAR MATERIAL AND FORMED AS CURVED FORM

(71) Applicant: Aknit International Ltd., Apia (WS)

(72) Inventor: Ming-Sheng Kuo, Apia (WS)

(73) Assignee: Aknit International Ltd., Apia (WS)

( * ) Notice: Subject to any disclaimer, the term of this patent is extended or adjusted under 35 U.S.C. 154(b) by 0 days.

(21) Appl. No.: 15/137,881

(22) Filed: Apr. 25, 2016

(51) Int. Cl.
*D04B 1/14* (2006.01)
*D04B 1/22* (2006.01)

(52) U.S. Cl.
CPC *D04B 1/14* (2013.01); *D04B 1/22* (2013.01)

(58) Field of Classification Search
CPC ..... D04B 1/123; D04B 1/02; D04B 1/102; D04B 1/18
See application file for complete search history.

(56) References Cited

U.S. PATENT DOCUMENTS 616,524 A * 12/1898 Cartledge ..... D04B 1/24 66/171
782,480 A * 2/1905 Benndorf ..... D04B 15/80 66/123
1,831,964 A * 11/1931 Vincent Lombardi .. D04B 1/14 66/190
1,976,885 A * 10/1934 Nathan Levin ..... D04B 1/00 66/190
2,040,965 A * 5/1936 Friedrich Verbeek Arnold ..... D04B 1/00 66/83
2,069,819 A * 2/1937 Hans Diem ..... D04B 1/00 66/190
2,105,301 A * 1/1938 Samuel Saftlas ..... D04B 1/14 66/190
2,108,925 A * 2/1938 Raynor ..... D04B 1/14 66/190
2,176,533 A * 10/1939 Logan ..... D04B 1/10 66/190
2,185,844 A * 1/1940 Gustav Gastrich .... D04B 11/00 66/126 R
2,236,758 A * 4/1941 Lumsden ..... D04B 1/18 66/190
3,115,693 A * 12/1963 Chandler ..... D04B 1/16 156/148
3,774,412 A * 11/1973 Schichman ..... D04B 9/18 28/271

(Continued)

*Primary Examiner* — Danny Worrell
(74) *Attorney, Agent, or Firm* — Muncy, Geissler, Olds & Lowe, P.C.

(57) ABSTRACT

A double-sided fabric embedded with a continuous linear material and formed as a curved form. The double-sided fabric is knit by a flat bed knitting machine including a front needle bed including front knitting needles, a back needle bed including back knitting needles and a loop presser bed including right-directed and left-directed knitting pressing pieces. The double-sided fabric includes a continuous linear material pressed by the right-directed and/or left-directed knitting pressing pieces and embedded into the double-sided fabric to form loop groups. Each loop group includes loops stitched and formed by one front knitting needle and two back knitting needles at two sides of the front knitting needle in a knitting process and in next knitting process. At least two of the loops groups are located in different knitting processes to cause a level drop in the continuous linear material to form at least one curved portion.

10 Claims, 15 Drawing Sheets

(56) References Cited

U.S. PATENT DOCUMENTS

| | | | | | |
|---|---|---|---|---|---|
| 3,964,277 | A * | 6/1976 | Miles | D04B 9/16 | 66/190 |
| 4,794,767 | A * | 1/1989 | Lombardi | D04B 1/123 | 28/155 |
| 5,299,435 | A * | 4/1994 | Whalley | D04B 1/123 | 66/190 |
| 6,151,922 | A | 11/2000 | Shimasaki | | |
| 2016/0265146 | A1* | 9/2016 | Liao et al. | D04B 13/00 | |

* cited by examiner

DOUBLE-SIDED FABRIC EMBEDDED WITH CONTINUOUS LINEAR MATERIAL AND FORMED AS CURVED FORM

FIELD OF THE INVENTION

The present invention relates to a double-sided fabric, and particularly to a double-sided fabric embedded with a continuous linear material.

BACKGROUND OF THE INVENTION

In the modern society that values health, environmental protection and fashion, consumers demand higher comfort and design requirements on garment fabrics. In response to market needs of human wear, fabric manufacturers focus on of making fabrics of different colors and pattern changes. If a continuous linear material can be embedded into a double-sided base yarn during a knitting process, not only a thicker and denser double-sided fabric having more pattern changes can be formed, but also the double-sided fabric manufactured may achieve more outstanding performances in fluffiness and shape sustainability. Such fabric is particularly suitable for making daily life consumer products including human outerwear, shoes or handbags. In currently existing technologies associated with a flat bed knitting machine that embeds a continuous linear material to be embedded, the embedding process of the continuous linear material to be embedded is performed by yarn stitching operations using a knitting needle. Thus, when the length of the continuous linear material to be embedded exceeds 1 inch, due a certain inclined angle produced when the continuous linear material is fed by a yarn feeder, the continuous linear material may not be reliably stitched by the knitting needle in the yarn stitching process, hence easily resulting in an unsatisfactory fabric. That is to say, in current technologies, the continuous linear material is not allowed to have a length that exceeds 1 inch. Thus, the development of the fabric manufactured from the above technologies is severely restrained. It should be noted that, the so-call flat bed knitting machine refers to a machine that includes a front needle bed and a back needle bed. Using the flat bed knitting machine, one of the beds may be applied for knitting to manufacture a single-sided fabric, or both of the front and back beds may be simultaneously applied for alternate knitting to manufacture a double-sided fabric.

To improve the above issue, the U.S. Pat. No. 6,151,922A discloses "Method of Knitting Inlaid Fabric and Inlaid Fabric Knitted by the Method". In the above disclosure of the method of knitting an inlaid fabric including an inlay yarn (equivalent to the foregoing embedded continuous linear material), the flat bed knitting machine used includes at least a pair of horizontally extending needle beds arranged in front and back to be opposed to each other across a needle gap and each having a number of needles. Each of the pair of needle beds includes a plurality of knitting needle capable of transferring stitches of loops between the needle beds, and either or both of the needle beds can be racked laterally. The knitting process of knitting the inlaid fabric including a base knitting fabric portion (equivalent to the foregoing base yarn) and the inlay yarn (equivalent to the foregoing continuous linear material) includes steps of: a step that the base knitting fabric portion is knitted; a step that inlay yarn holding loops are formed by retaining loops of the base knitting fabric portion retained by the needles on the first needle bed to said needles on the opposed second needle bed through a split knit process, whereby the loops are retained to the needles on both of the first and second needle beds; a step that the inlay yarn is made to run across the loops retained to the needles on the first and second needle beds; a step that the inlay yarn holding loops retained by the needles on the second needle bed are transferred to the needles on the first needle bed to be overlapped with the loops of the base knitting fabric portion; and a step that a yarn is fed to the needles of the first needle bed to form loops of the next course. The above disclosure further discloses an inlaid fabric knitted by the above method. The inlaid fabric is characterized that, an elastic yarn is used as a base knitting fabric portion and a non-elastic yarn is used as inlay yarn, and the elastic yarn is knitted in its stretched state during the knitting so that the inlay yarn can be formed into a pile-like form. It is seen from the above disclosure that, one main purpose of using a non-elastic yarn as the inlay yarn is to maintain a final shape of the inlay fabric. Thus, only when knitting process of the above disclosure is complete, the base knitting fabric portion using an elastic yarn can then be shrunk back to the pile-like form. Thus, it is known that, in the knitting method of the above disclosure, the needles of one of the needle beds of the flat needle bed machine are applied for knitting the base yarn, whereas the other needle bed is used to transfer stitches of loops that maintain the positions of the inlay yarn after having been transferred. That is to say, instead of being capable of manufacturing a double-sided fabric, the above knitting method is only capable of manufacturing a single-sided fabric. Further, as the inlay yarn of the above disclosure cannot be inlaid into the base knitting fabric portion in different knitting processes, the inlay yarn of the above disclosure cannot form a curved form. Thus, the above disclosure fails to meet consumer market requirements. Therefore, there is a need for a solution for solving the issues and limitations of the above disclosure.

SUMMARY OF THE INVENTION

The primary object of the present invention is to solve issues of the above conventional disclosure. That is to say, it is a primary object of the present invention to embed a continuous linear material into a double-sided fabric during different knitting processes to form a curved form, such that the continuous linear material may more flexibly adopt a special heterogeneous material (such as a conductive yarn formed by a wire process) and be embedded into the double-sided fabric, thereby effectively satisfying requirement of fast changes of the consumer market.

According to the above object, the present invention provides a double-sided fabric embedded with a continuous linear material and formed as a curved form. The double-sided fabric is knit by a flat bed knitting machine, which includes a front needle bed, a back needle bed, and a loop presser bed. The front needle bed includes a plurality of front knitting needles. The back needle beds includes a plurality of back knitting needles at corresponding positions staggered from the front knitting needles. The loop presser bed is above the front needle bed or the back needle bed, and includes a plurality of right-directed knitting pressing piece and left-directed knitting pressing pieces alternately arranged in gaps of the plurality of front knitting needles and the plurality of back knitting needles, respectively. The double-sided fabric includes a continuous linear material pressed by the plurality of right-directed knitting pressing pieces and/or the plurality of left-directed knitting pressing pieces and thus embedded into the double-sided fabric. The continuous linear material is embedded into the double-sided fabric to form a plurality of loop groups. Each of the loop groups includes loops stitched and formed by one of the front knitting needles and two of the back knitting needles at two sides of the front knitting needle in a knitting process and the front knitting needle and the two back knitting needles in a next knitting process. Further, at least two of the plurality of loops groups are located in different knitting processes to cause a level drop in the continuous linear material to form at least one curved portion.

Further, in the double-sided fabric embedded with a continuous linear material and formed as a curved form, the continuous linear material is embedded from the front needle bed towards the double-sided fabric, and is withdrawn from the front needle bed and departs the double-sided fabric.

Further, in the double-sided fabric embedded with a continuous linear material and formed as a curved form, the continuous linear material is embedded from the front needle bed towards the double-sided fabric, and is withdrawn from the back needle bed and departs the double-sided fabric.

Further, in the double-sided fabric embedded with a continuous linear material and formed as a curved form, the continuous linear material is embedded from the back needle bed towards the double-sided fabric, and is withdrawn from the back needle bed and departs the double-sided fabric.

Further, in the double-sided fabric embedded with a continuous linear material and formed as a curved form, the continuous linear material is embedded from the back needle bed towards the double-sided fabric, and is withdrawn from the front needle bed and departs the double-sided fabric.

Further, in the double-sided fabric embedded with a continuous linear material and formed as a curved form, the continuous linear material is at least one selected from a group consisting of a conductive wire material and a non-conductive wire material.

It is known from the above technical solution that, the present invention achieves following effects compared to the prior art. First of all, in the present invention, the continuous linear material can be embedded into the double-sided fabric, such that the double-sided fabric may maintain preferred thickness and a piling effect to satisfy consumer needs. Secondly, in the present invention, the continuous linear material may meanwhile form a curved form when embedded into the double-sided fabric to be manufactured into more colorful fabrics with more pattern changes. Thirdly, in the present invention, while embedding the continuous linear material into the double-sided fabric, the front knitting needles and the back knitting needles do not stitch the continuous linear material, hence eliminating an issue of damaging the continuous linear material. Further, as the continuous linear material may form a curved form when embedded into the double-sided fabric, the continuous linear material may more flexibly adopt a special heterogeneous material (such as a conductive yarn formed by a wire process) and be embedded into the double-sided fabric, thereby effectively satisfying requirements of fast changes of the consumer market.

DETAILED DESCRIPTION OF THE PREFERRED EMBODIMENTS

First of all, it should be noted that a flat bed knitting machine described in the present invention is a known model (model number: SVR093SP) made by Shima Seiki Mfg., Ltd, Japan. However, this model is not to be construed as a limitation to the present invention. As the above flat bed knitting machine is technology generally known to one person skilled in the art, the structure of the flat bed knitting machine is described in brief in the application, and associated details and denotations are omitted herein. The flat bed knitting machine at least includes a front needle bed, a back needle bed, a loop presser bed, a carriage above the front needle bed, the back needle bed and the loop presser bed, and a plurality of yarn feeders below the carriage. The front needle bed includes a plurality of front knitting needles. The back needle bed includes a plurality of back knitting needles. The loop presser bed is above the front needle bed or the back needle bed, and includes corresponding right-directed knitting pressing pieces and left-directed knitting pressing pieces alternately arranged in gaps of the plurality of front knitting needles and the plurality of back knitting needles, respectively. Technical details of the double-sided fabric embedded with a continuous linear material and formed as a curved form according to preferred embodiments of the present invention are given with the accompanying drawings below.

Figure 1:
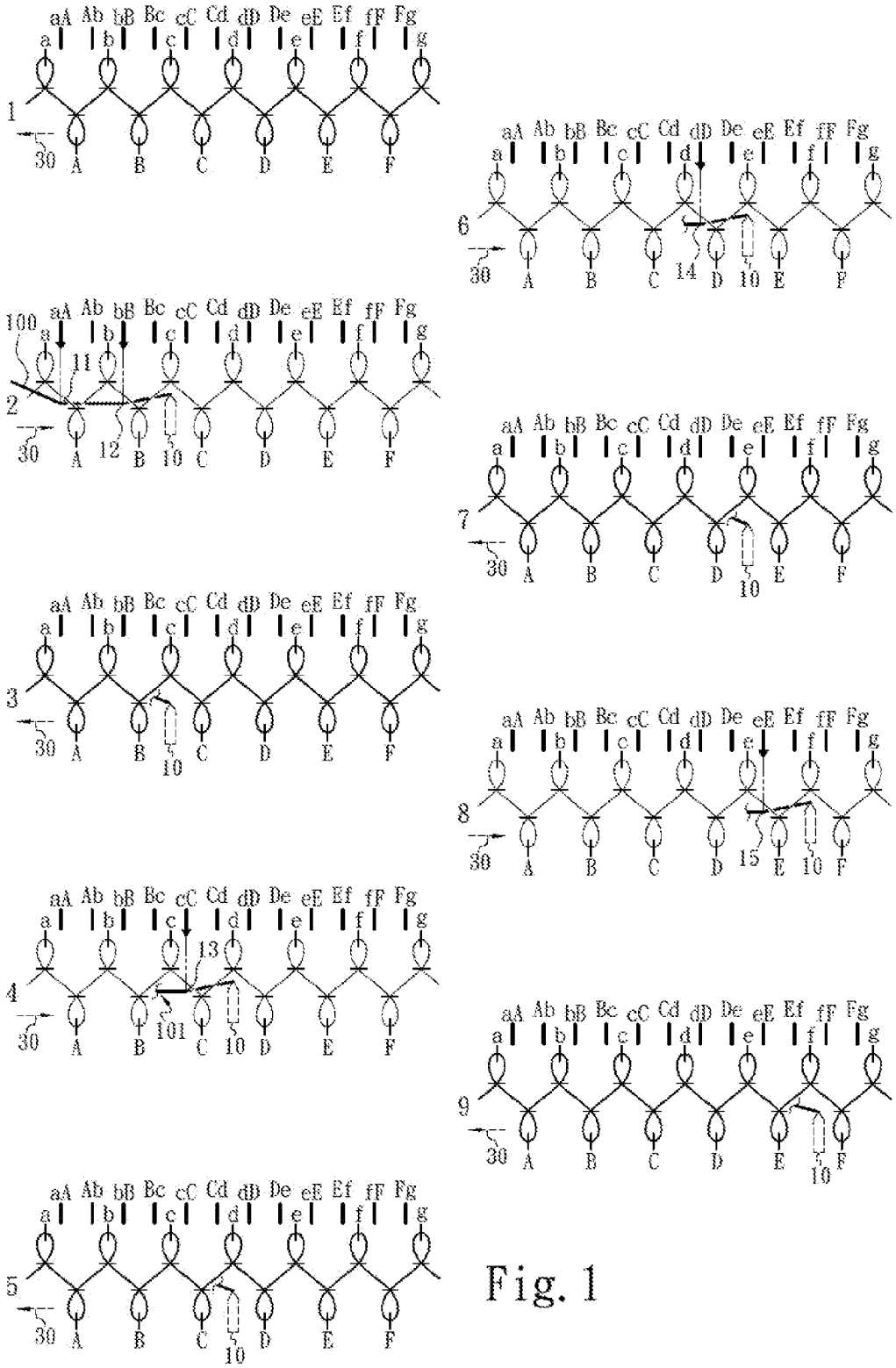
FIG. 1 shows a diagram of partial knitting processes according to a first preferred embodiment of the present invention.
Figure 2:
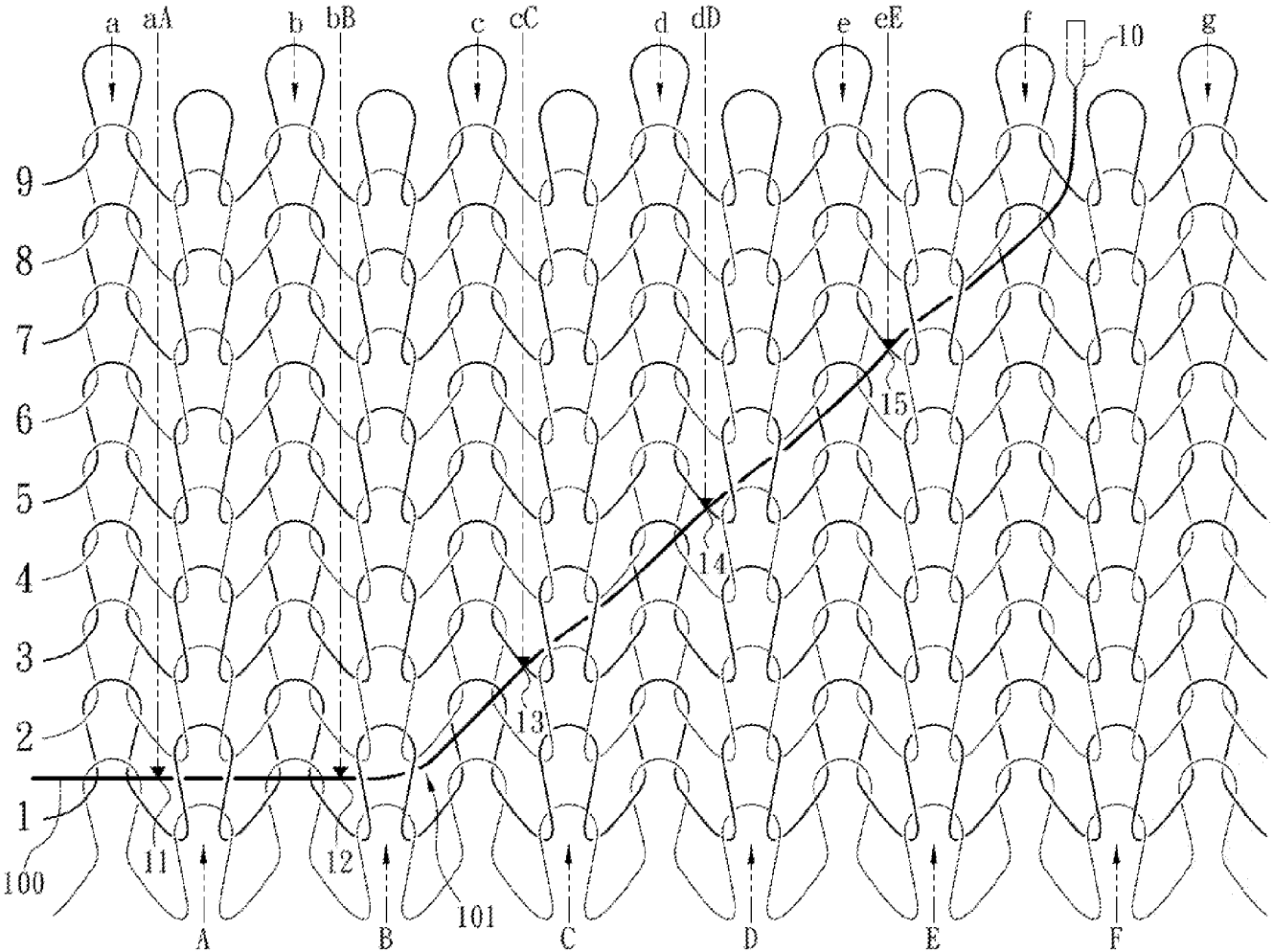
FIG. 2 is a planar schematic diagram of a double-sided fabric knit according to FIG. 1 of the present invention.
Figure 3:
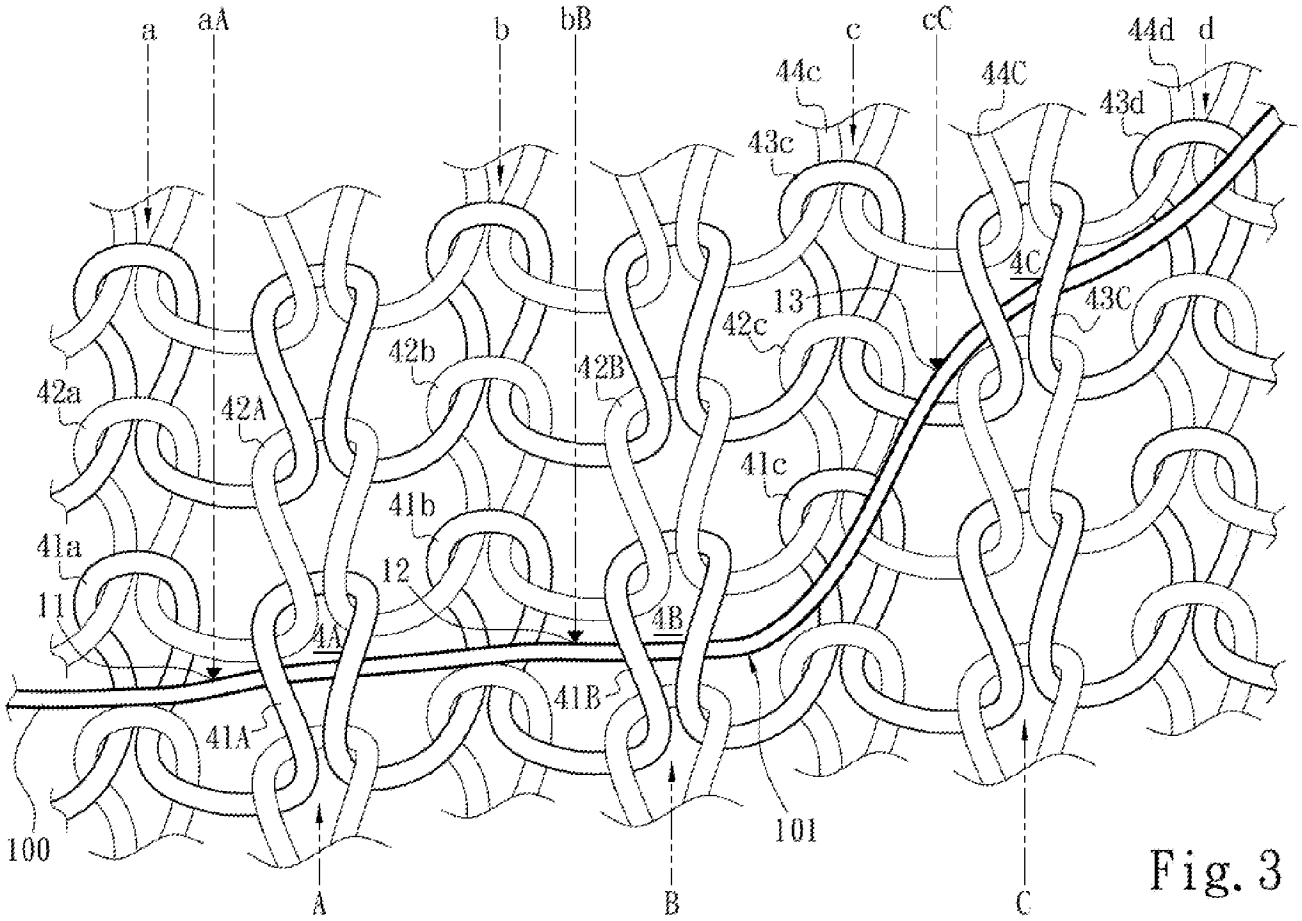
FIG. 3 is an enlarged partial schematic diagram of FIG. 2 of the present invention.

FIG. 1 to FIG. 3 show a schematic diagram of partial knitting processes according to a first preferred embodiment of the present invention, and a planar schematic diagram and an enlarged partial schematic diagram of a double-sided fabric knit according to the knitting processes in FIG. 2, respectively. As seen from FIG. 2 and FIG. 3, the present invention provides a double-sided fabric embedded with a continuous linear material and formed as a curved form. The double-sided fabric is knit by the foregoing flat bed knitting machine. The front needle bed includes a plurality of front knitting needles A to F. The back needle bed includes a plurality of back knitting needles a to g at corresponding position staggered from the plurality of front knitting needles A to F. The loop presser bed is above the front needle bed or the back needle bed, and includes corresponding right-directed knitting pressing pieces aA, bB, cC, dD, eE and fi and left-directed knitting pressing pieces Fg, Ef, De, Cd, Bc and Ab alternately arranged in gaps of the plurality of front knitting needles A to F and the plurality of back knitting needles a to g, respectively. The double-sided fabric includes a continuous linear material 100, which is pressed by the right-directed knitting pressing pieces aA, bB, cC, dD and eE and thus embedded into the double-sided fabric. The continuous linear material 100 is at least one selected from a group consisting of a conductive wire material (e.g., a conductive yarn, conductive fiber or enameled copper wire) and a non-conductive wire material (e.g., a cotton thread, linen thread, wool yarn or synthetic fiber). The continuous linear material 100 is embedded into the double-sided fabric to form a plurality of loop groups 4A, 4B and 4C (an example of a partial enlarged schematic diagram is shown in FIG. 3 for illustration purposes). Also referring to FIG. 1, it should be noted that, the loop group 4A is formed by loops 41A, 41*a*, 41*b*, 42A, 42*a* and 42*b* stitched by the front knitting needle A and the back knitting needles a and b at the two sides of the front knitting needle A in a knitting process 1, and the needle A and the two back knitting needles a and b in a next knitting process 2. The loop group 4B is formed by loops 41B, 41*b*, 41*c*, 42B, 42*b* and 42*c* stitched by the front knitting needle B and the back knitting needles b and c at the two sides of the front knitting needle B in the knitting process 1, and the front knitting needle B and the back knitting needles b and c in the next knitting process 2. The loop group 4C is formed by loops 43C, 43*c*, 43*d*, 44C, 44*c* and 44*d* stitched by the front knitting needle C and the back knitting needles c and d at the two sides of the front knitting needle C in a knitting process 3, and the front knitting needle C and the two back knitting needles c and d in a next knitting process 4. The loop group 4B is located in the knitting processes 1 and 2, and is different from the loop group 4C located in the knitting processes 3 and 4. Thus, a level drop caused in the continuous linear material 100 may form a curved portion 101. The continuous linear material 100 may be embedded from the front needle bed towards the double-sided fabric, and be withdrawn from the front needle bed and depart the double-sided fabric. Alternatively, the continuous linear material 100 may be embedded from the front needle bed towards the double-sided fabric, and be withdrawn from the back needle bed and depart the double-sided fabric. Similarly, the continuous linear material 100 may be embedded from the back needle bed towards the double-sided fabric, and be withdrawn from the back needle bed and depart the double-sided fabric. Alternatively, the continuous linear material 100 may be embedded from the back needle bed towards the double-sided fabric, and withdrawn from the front needle bed and depart the double-sided fabric.

To better describe the present invention, referring to FIG. 1 showing a schematic diagram of partial knitting processes according to the first preferred embodiment of the present invention, when the flat bed knitting machine applied in the present invention starts knitting along a carriage operation direction 30 to the left side as shown, the front knitting needles A to F and the back knitting needles a to g stitch and form the loops as the knitting process 1 shown. Referring to FIG. 3, after the knitting process 2 is performed along the carriage operation direction 30 to the right side, as a yarn feeder 10 progresses to before the front knitting needle A, the right-directed knitting pressing piece aA immediately presses a first pressing point 11 of the continuous linear material 100 downwards, such that the continuous linear material 100 allows the loop 41A to be fixed by the loops 42A, 42*a* and 42*b* formed in the knitting process 2 as the yarn feeder 10 progresses to the back knitting needle b, and to cause the continuous linear material 100 to be embedded into the loop group 4A. When the yarn feeder 10 continues progressing to before the front knitting needle B, the right-directed knitting pressing piece bB immediately presses a second pressing point 12 of the continuous linear material 100, such that the continuous linear material 100 allows the loop 41B to be fixed by the loops 42B, 42*b* and 42*c* formed in the knitting process 2 as the yarn feeder 10 progresses to the back knitting needle c, and to cause the continuous linear material 100 to be embedded into the loop group 4B. After the carriage operation direction 30 again moves to the left side, the yarn feeder 10 is located above the back knitting needle c at this point, and is lifted to set this position as a starting position for the next yarn feeding. Correspondingly, the front knitting needles A to F and the back knitting needles a to g stitch to form loops as the knitting process 3 shown. After the knitting process 4 is performed along the carriage operation direction 30 to the right side, as the yarn feeder 10 progresses to before the front knitting needle C, the right-directed knitting pressing piece cC immediately presses a third pressing point 13 of the continuous linear material 100 downwards, such that the continuous linear material 100 allows the loop 43C to be fixed by the loops 44C, 44*c* and 44*d* formed in the knitting process 4, and to cause the continuous linear material 100 to be embedded into the loop group 4C. At this point, the loop group 4B is located in the knitting processes 1 and 2, and is different from the loop group 4C located in the knitting processes 3 and 4. Thus, the level drop caused in the continuous linear material 100 may form a curved portion 101. Similarly, when the carriage operation direction 30 again moves to the left side, the yarn feeder 10 is located above the back knitting needle d at this point, and is lifted to set this position as a starting position for the next yarn feeding. Correspondingly, the front knitting needles A to F and the back knitting needles a to g stitch to form loops as the knitting process 5 shown. After the knitting process 6 is performed along the carriage operation direction 30 to the right side, as the yarn feeder 10 progresses to before the front knitting needle D, the right-directed knitting pressing piece dD immediately presses a fourth pressing point 14 of the continuous linear material 100 downwards, such that the continuous linear material 100 is caused to be embedded into the double-sided fabric as the yarn feeder 10 progresses to the back knitting needle e. Further, when the carriage operation direction 30 again moves to the left side, the yarn feeder 10 is located above the back knitting needle e at this point, and is lifted to set this position as a starting position for the next yarn feeding. Correspondingly, the front knitting needles A to F and the back knitting needles a to g stitch to form loops as the knitting process 7 shown. After the knitting process 8 is performed along the carriage operation direction 30 to the right side, as the yarn feeder 10 progresses to before the front knitting needle E, the right-directed knitting pressing piece eE immediately presses a fifth pressing point 15 of the continuous linear material 100 downwards, such that the continuous linear material 100 is caused to be embedded into the double-sided fabric as the yarn feeder 10 progresses to the back knitting needle f to form a loop group (as details of forming and components of the loop group are disclosed in the foregoing description, and to keep the denotations of the drawings and the description simple, the loop groups in the following description are not denoted nor further described). Finally, when the carriage operation direction 30 again moves to the left side, the yarn feeder 10 is located above the back knitting needle f at this point and is lifted. Correspondingly, the front knitting needles A to F and the back knitting needles a to g stitch to form loops as the knitting process 9 shown. Thus, the double-sided fabric embedded with a continuous linear material and formed as a curved form shown in FIG. 2 of the present invention is manufactured.

Figure 4:
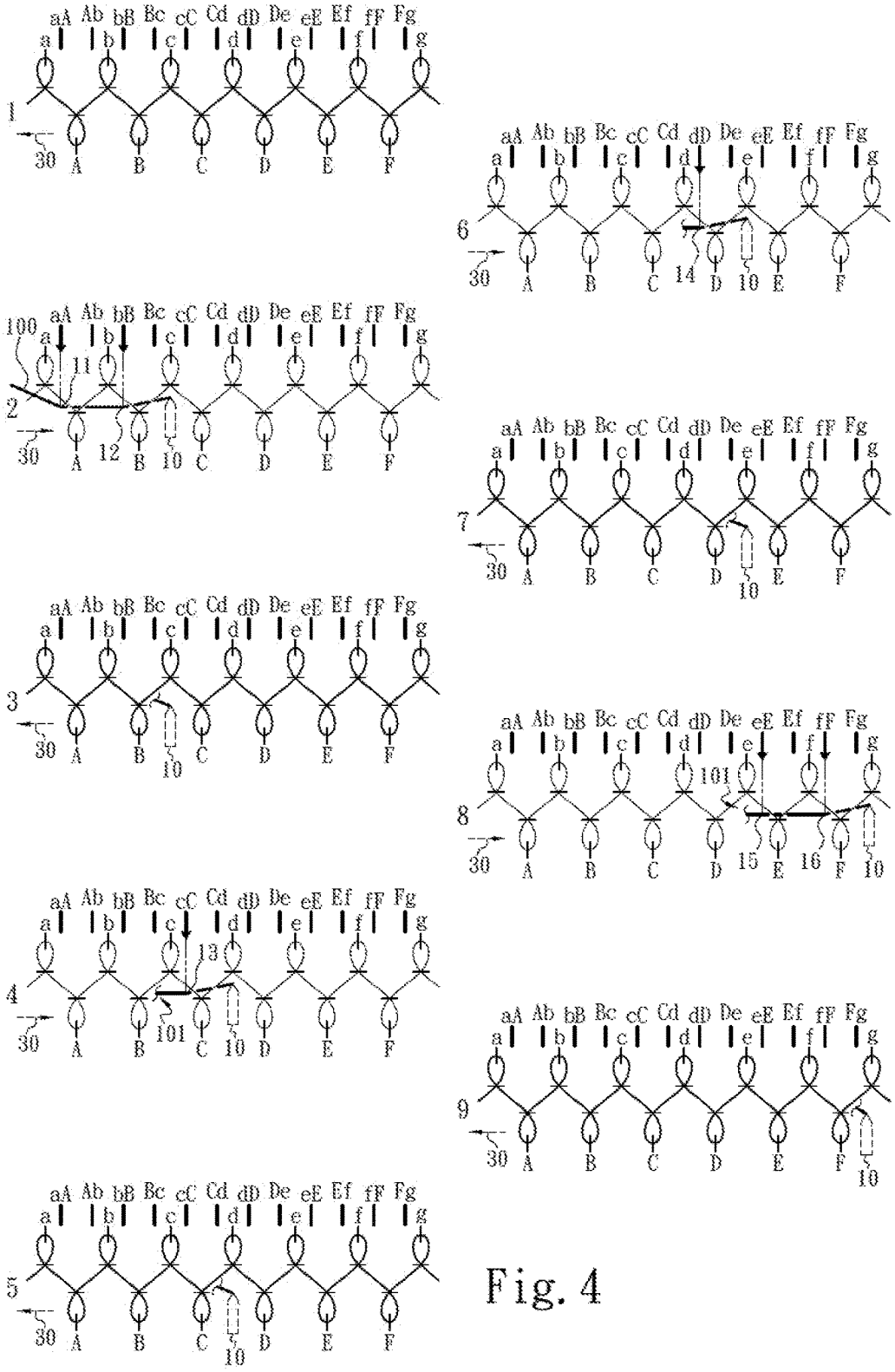
FIG. 4 shows a diagram of partial knitting processes according to a second preferred embodiment of the present invention.
Figure 5:
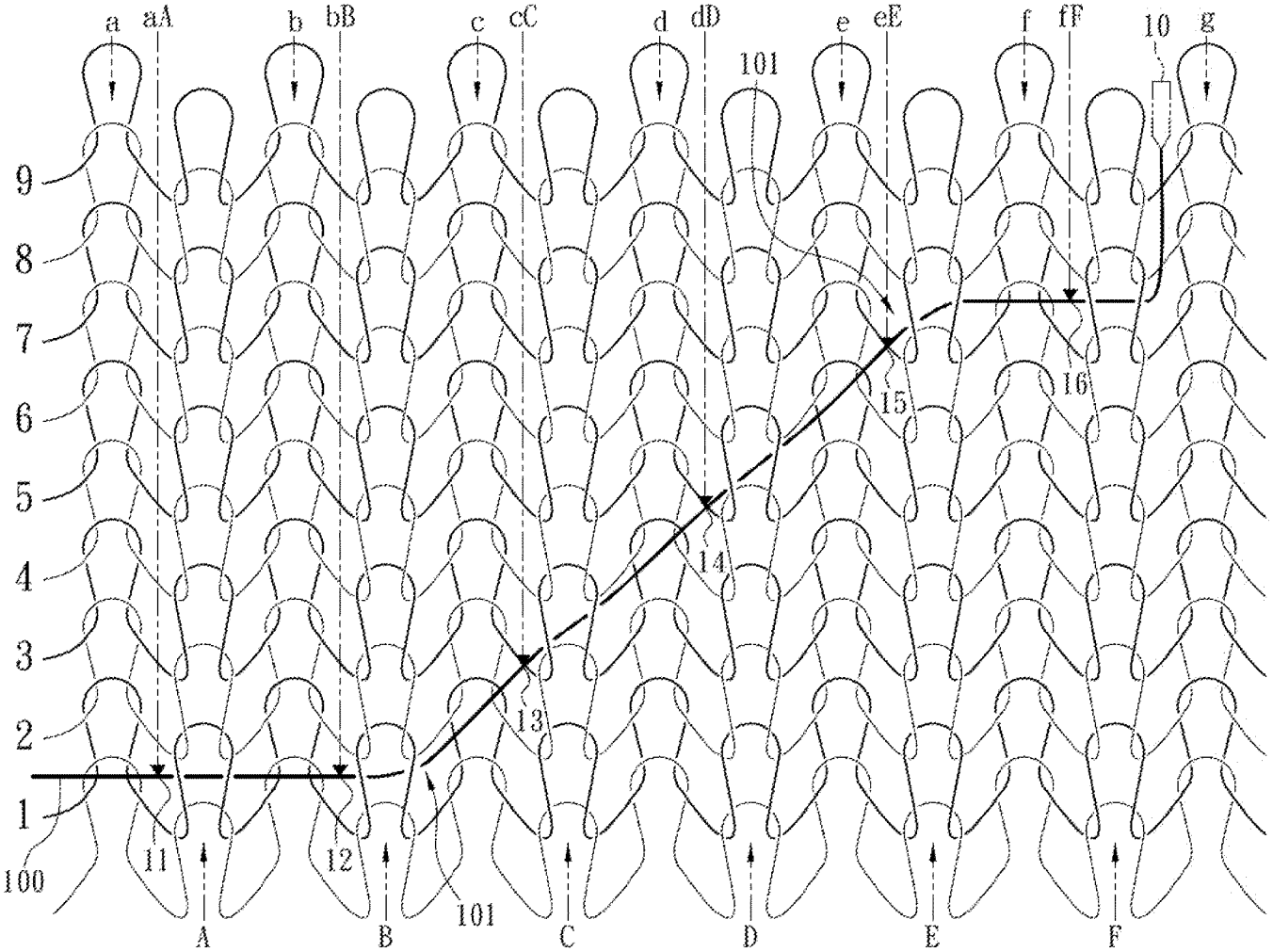
FIG. 5 is a planar schematic diagram of a double-sided fabric knit according to FIG. 4 of the present invention.

FIG. 4 and FIG. 5 are a diagram of partial knitting processes according to a second preferred embodiment of the present invention and a planar schematic diagram of a double-sided fabric knit according to the diagram of partial knitting processes, respectively. Referring to FIG. 4 and FIG. 5, it is clearly seen that, the front needle bed includes a plurality of front knitting needles A to F, the back needle bed includes a plurality of back knitting needles a to g, and the loop presser bed is above the front needle bed or the back needle bed, and includes corresponding right-directed knitting pressing pieces aA, bB, cC, dD, eE and fi and left-directed knitting pressing pieces Fg, Ef, De, Cd, Bc and Ab alternately arranged in gaps of the plurality of front knitting needles A to F and the plurality of back knitting needles a to g, respectively. The double-sided fabric includes a continuous linear material 100, which is pressed by the right-directed knitting pressing pieces aA, bB, cC, dD and eE and thus embedded in the double-sided fabric. To better describe the second preferred embodiment of the present invention, when the flat bed knitting machine applied in the present invention starts knitting according to the carriage operation direction 30 to the left side as shown in FIG. 4, the front knitting needles A to F and the back knitting needles a to g stitch to form loops as the knitting process 1 shown. After the carriage operation direction 30 performs the operation of the knitting process 2 to the right side, as the yarn feeder 10 progresses to before the front knitting needle A, the right-directed knitting pressing piece aA immediately presses a first pressing point 11 of the continuous linear material 100 downwards, such that the continuous linear material 100 is allowed to be embedded into the double-sided fabric as the yarn feeder 10 progresses to the back knitting needle b to form a loop group. When the yarn feeder 10 continues progressing to before the front knitting needle B, the right-directed knitting pressing piece bB immediately presses a second pressing point 12 of the continuous linear material 100, such that the continuous linear material 100 is allowed to be embedded into double-sided fabric as the yarn feeder 10 progresses to the back knitting needle c to form a loop group. After the carriage operation direction 30 again moves to the left side, the yarn feeder 10 is located above the back knitting needle c at this point, and is lifted to set this position as a starting position for the next yarn feeding. Correspondingly, the front knitting needles A to F and the back knitting needles a to g stitch to form loops as the knitting process 3 shown. After the knitting process 4 is performed along the carriage operation direction 30 to the right side, as the yarn feeder 10 progresses to before the front knitting needle C, the right-directed knitting pressing piece cC immediately presses a third pressing point 13 of the continuous linear material 100 downwards, such that the continuous linear material 100 is allowed to be embedded into double-sided fabric as the yarn feeder 10 progresses to the back knitting needle d to form a loop group. At this point, the level drop in the continuous linear material 100 forms a curved portion 101. Similarly, after the carriage operation direction 30 again moves to the left side, the yarn feeder 10 is located above the back knitting needle d at this point, and is lifted to set this position as a starting position for the next yarn feeding. Correspondingly, the front knitting needles A to F and the back knitting needles a to g stitch to form loops as the knitting process 5 shown. After the knitting process 6 is performed along the carriage operation direction 30 to the right side, as the yarn feeder 10 progresses to before the front knitting needle D, the right-directed knitting pressing piece dD immediately presses a fourth pressing point 14 of the continuous linear material 100 downwards, such that the continuous linear material 100 is allowed to be embedded into double-sided fabric as the yarn feeder 10 progresses to the back knitting needle e to form a loop group. After the carriage operation direction 30 again moves to the left side, the yarn feeder 10 is located above the back knitting needle e at this point, and is lifted to set this position as a starting position for the next yarn feeding. Correspondingly, the front knitting needles A to F and the back knitting needles a to g stitch to form loops as the knitting process 7 shown. After the knitting process 8 is performed along the carriage operation direction 30 to the right side, as the yarn feeder 10 progresses to before the front knitting needle E, the right-directed knitting pressing piece eE immediately presses a fifth pressing point 15 of the continuous linear material 100 downwards, such that the continuous linear material 100 is allowed to be embedded into double-sided fabric as the yarn feeder 10 progresses to the back knitting needle f to form a loop group. At this point, the level drop in the continuous linear material 100 forms another curved portion 101. When the yarn feeder 10 continues progressing to the front knitting needle F, the right-directed knitting pressing piece fi immediately presses a sixth pressing point 16 of the continuous linear material 100 downwards, such that the continuous linear material 100 is allowed to be embedded into the double-sided fabric as the yarn feeder 10 progresses to the back knitting needle g to form a loop group. Finally, after the carriage operation direction 30 again moves to the left, the yarn feeder 10 is located above the back knitting needle g at this point, and is lifted to set this position as a starting position for the next yarn feeding. Correspondingly, the front knitting needles A to F and the back knitting needles a to g stitch to form loops as the knitting process 9 shown. Thus, the double-sided fabric embedded with a continuous linear material and formed as a curved form in FIG. 5 of the present invention is manufactured.

Figure 6:
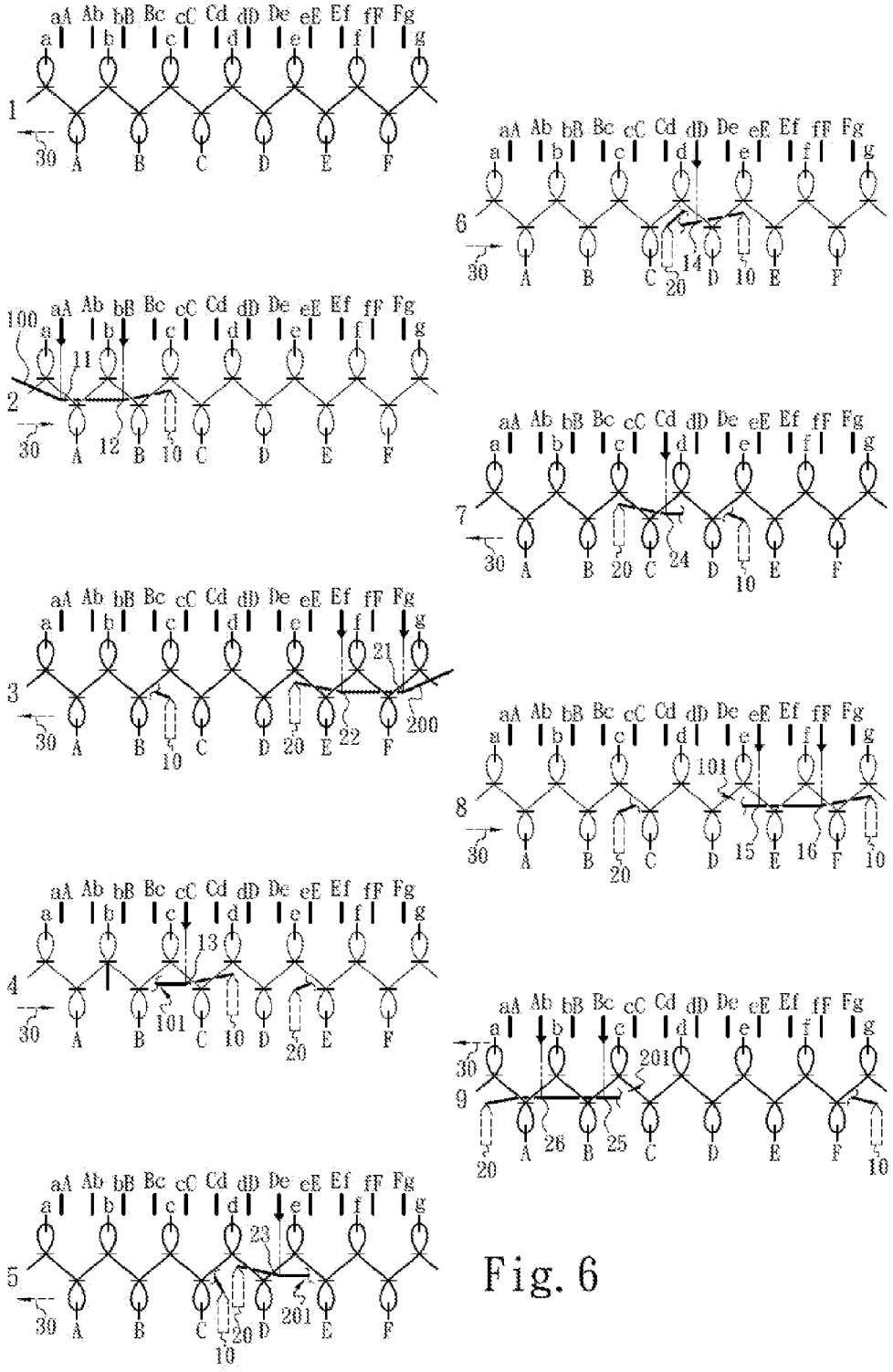
FIG. 6 shows a diagram of partial knitting processes according to a third preferred embodiment of the present invention.
Figure 7:
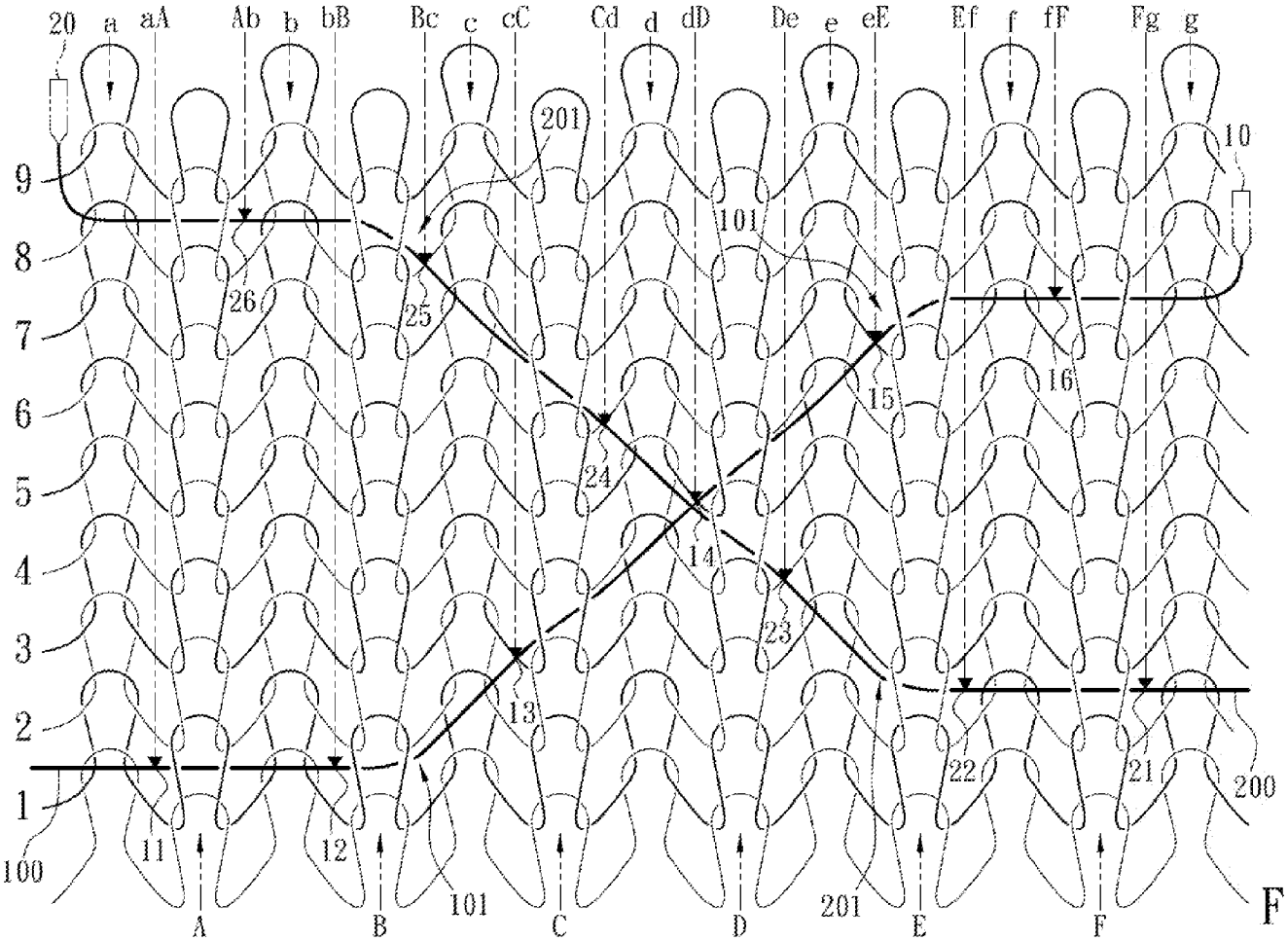
FIG. 7 is a planar schematic diagram of a double-sided fabric knit according to FIG. 6 of the present invention.

FIG. 6 and FIG. 7 show a diagram of partial knitting processes according to a third preferred embodiment of the present invention, and a planar schematic diagram of a double-sided fabric knit according to the diagram of partial knitting processes, respectively. Referring to FIG. 6 and FIG. 7, it is clearly seen that, the front needle bed includes a plurality of front knitting needles A to F, the back needle bed includes a plurality of back knitting needles a to g at corresponding position staggered from the plurality of front knitting needles A to F, and the loop presser bed is above the front needle bed or the back needle bed, and includes corresponding right-directed knitting pressing pieces aA, bB, cC, dD, eE and fi and left-directed knitting pressing pieces Fg, Ef, De, Cd, Bc and Ab alternately arranged in gaps of the plurality of front knitting needles A to F and the plurality of back knitting needles a to g, respectively. The double-sided fabric includes a continuous linear material 100 that is pressed by the right-directed knitting pressing pieces aA, bB, cC, dD, eE and fi and thus embedded into the double-sided fabric, and a continuous linear material 200 pressed by the left-directed knitting pressing pieces Fg, Ef, De, Cd, Bc and Ab and thus embedded into the double-sided fabric. To better describe the third preferred embodiment of the present invention, when the flat bed knitting machine applied in the present invention starts knitting according to the carriage operation direction 30 to the left side as shown in FIG. 6, the front knitting needles A to F and the back knitting needles a to g stitch to form loops as the knitting process 1 shown. After the carriage operation direction 30 performs the operation of the knitting process 2 to the right side, as the yarn feeder 10 progresses to before the front knitting needle A, the right-directed knitting pressing piece aA immediately presses a first pressing point 11 of the continuous linear material 100 downwards, such that the continuous linear material 100 is allowed to be embedded into the double-sided fabric as the yarn feeder 10 progresses to the back knitting needle b to form a loop group. When the yarn feeder 10 continues progressing to before the front knitting needle B, the right-directed knitting pressing piece bB immediately presses a second pressing point 12 of the continuous linear material 100, such that the continuous linear material 100 is allowed to be embedded into double-sided fabric as the yarn feeder 10 progresses to the back knitting needle c to form a loop group. After the carriage operation direction 30 again moves to the left side, the yarn feeder 10 is located above the back knitting needle c at this point, and is lifted to set this position as a starting position for the next yarn feeding. Meanwhile, another yarn feeder 20 is provided to feed the continuous linear material 200 from the back knitting needle g from the right side to the left side. When the yarn feeder 20 progresses to before the front knitting needle F, the left-directed knitting pressing piece Fg immediately presses a first pressing point 21 of the continuous linear material 200 downwards, such that the continuous linear material 200 is allowed to be embedded into the double-sided fabric as the yarn feeder 20 progresses to the back knitting needle f to form a loop group. When the yarn feeder 20 continues progressing to before the front knitting needle E, the right-directed knitting pressing piece Ef immediately presses a second pressing point 22 of the continuous linear material 200 downwards, such that the continuous linear material 200 is allowed to be also embedded into the double-sided fabric as the yarn feeder 20 progresses to the back knitting needle e to form a loop group. When the yarn feeder 20 continues progressing to the left side, the front knitting needles A to F and the back knitting needles a to g stitch to form loops as the knitting process 3 shown. After the knitting process 4 is performed along the carriage operation direction 30 to the right side, as the yarn feeder 10 progresses to before the front knitting needle C, the right-directed knitting pressing piece cC immediately presses a third pressing point 13 of the continuous linear material 100 downwards, such that the continuous linear material 100 is allowed to be embedded into double-sided fabric as the yarn feeder 10 progresses to the back knitting needle d to form a loop group. At this point, the level drop in the continuous linear material 100 forms a curved portion 101, and the yarn feeder 20 is located above the back knitting needle e, and is lifted to set this position as a starting position for the next yarn feeding. Similarly, after the carriage operation direction 30 again moves to the left side, the yarn feeder 10 is located above the back knitting needle d at this point, and is lifted to set this position as a starting position for the next yarn feeding. When the yarn feeder 20 progresses to before the front knitting needle D, the left-directed knitting pressing piece De immediately presses a third pressing point 23 of the continuous linear material 200 downwards, such that the continuous linear material 200 is allowed to be embedded into the double-sided fabric as the yarn feeder 20 progresses to the back knitting needle d to form a loop group. At this point, the level drop in the continuous linear material 200 forms a curved portion 201. When the yarn feeder 20 continues progressing to the left side, the front knitting needles A to F and the back knitting needles a to g stitch to form loops as the knitting process 5 shown. After the knitting process 6 is performed along the carriage operation direction 30 to the right side, as the yarn feeder 10 progresses to before the front knitting needle D, the right-directed knitting pressing piece dD immediately presses a fourth pressing point 14 of the continuous linear material 100 downwards, such that the continuous linear material 100 is allowed to be embedded into double-sided fabric as the yarn feeder 10 progresses to the back knitting needle e to form a loop group. At this point, the yarn feeder 20 is located above the back knitting needle d, and is lifted to set this position as a starting position for the next yarn feeding. Further, after the carriage operation direction 30 again moves to the left side, the yarn feeder 10 is located above the back knitting needle e at this point, and is lifted to set this position as a starting position for the next yarn feeding. When the yarn feeder 20 progresses to before the front knitting needle C, the left-directed knitting pressing piece Cd immediately presses a fourth pressing point 24 of the continuous linear material 200 downwards, such that the continuous linear material 200 is allowed to be embedded into the double-sided fabric as the yarn feeder 20 progresses to the back knitting needle c to form a loop group. Correspondingly, the front knitting needles A to F and the back knitting needles a to g stitch to form loops as the knitting process 7 shown. After the knitting process 8 is performed along the carriage operation direction 30 to the right side, as the yarn feeder 10 progresses to before the front knitting needle E, the right-directed knitting pressing piece eE immediately presses a fifth pressing point 15 of the continuous linear material 100 downwards, such that the continuous linear material 100 is allowed to be embedded into double-sided fabric as the yarn feeder 10 progresses to the back knitting needle f to form a loop group. At this point, the level drop in the continuous linear material 100 forms another curved portion 101. When the yarn feeder 10 continues progressing to the front knitting needle F, the right-directed knitting pressing piece fi immediately presses a sixth pressing point 16 of the continuous linear material 100 downwards, such that the continuous linear material 100 is allowed to be also embedded into the double-sided fabric as the yarn feeder 10 progresses to the back knitting needle g to form a loop group. At this point, the yarn feeder 20 is located above the back knitting needle c, and is lifted to set this position as a starting position for the next yarn feeding. Finally, after the carriage operation direction 30 again moves to the left side, the yarn feeder 10 is located above the back knitting needle f at this point, and is lifted. As the yarn feeder 20 progresses to before the front knitting needle B, the left-directed knitting pressing piece Bc immediately presses a fifth pressing point 25 of the continuous linear material 200 downwards, such that the continuous linear material 200 is allowed to be embedded into the double-sided fabric as the yarn feeder 20 progresses to the back knitting needle b to form a loop group. At this point, the level drop in the continuous linear material 200 forms another curved portion 201. When the yarn feeder 20 continues progressing to before the front knitting needle A, the left-directed knitting pressing piece Ab again immediately presses a sixth pressing point 26 of the continuous linear material 200, such that the continuous linear material 200 is allowed to be also embedded into the double-sided fabric as the yarn feeder 20 progresses to the back knitting needle a to form a loop group. Correspondingly, the front knitting needles A to F and the back knitting needles a to g stitch to form loops as the knitting process 9 shown. Thus, the double-sided fabric embedded with a continuous linear material and formed as a curved form shown in FIG. 7 of the present invention is manufactured.

Figure 8:
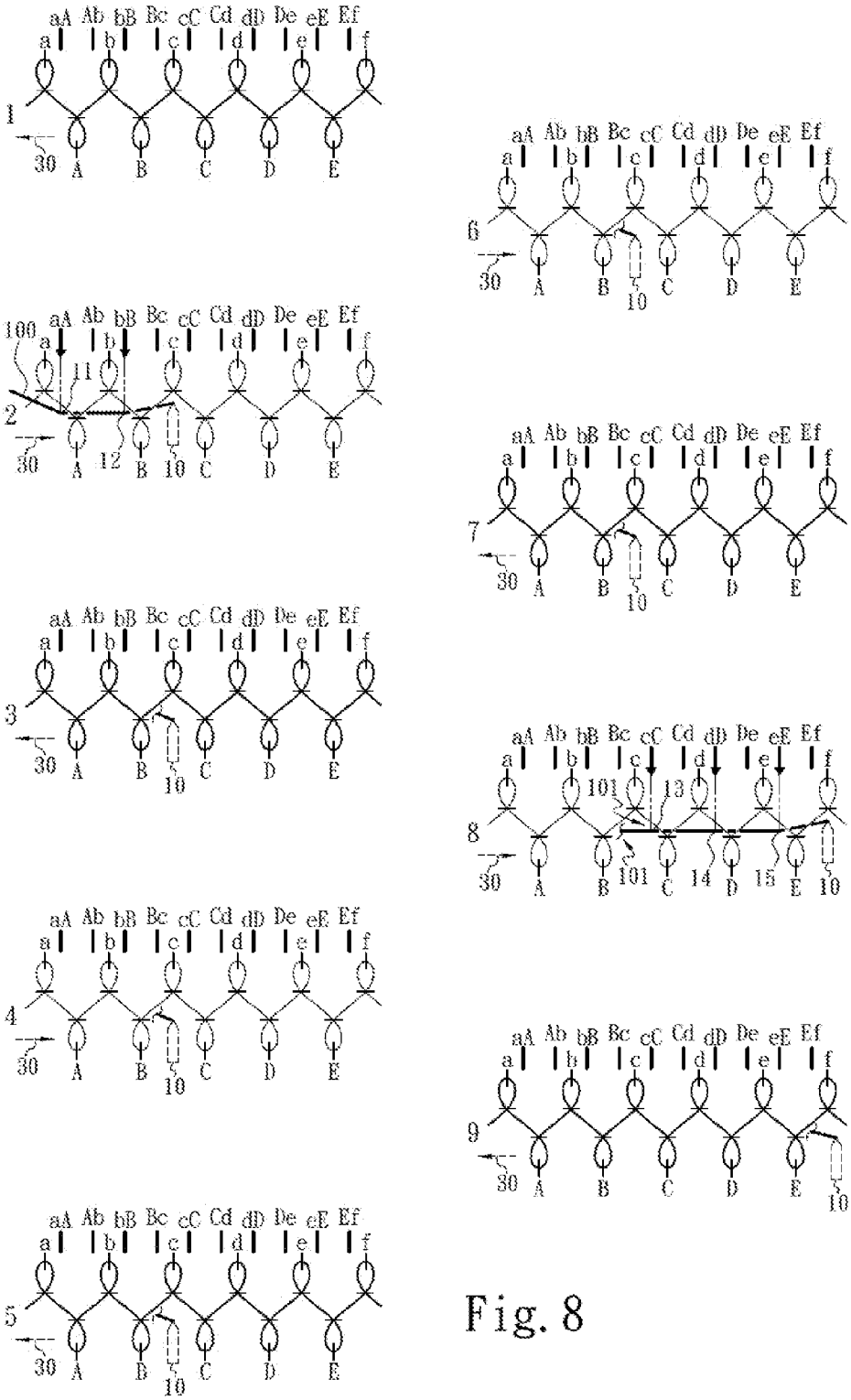
FIG. 8 shows a diagram of partial knitting processes according to a fourth preferred embodiment of the present invention.
Figure 9:
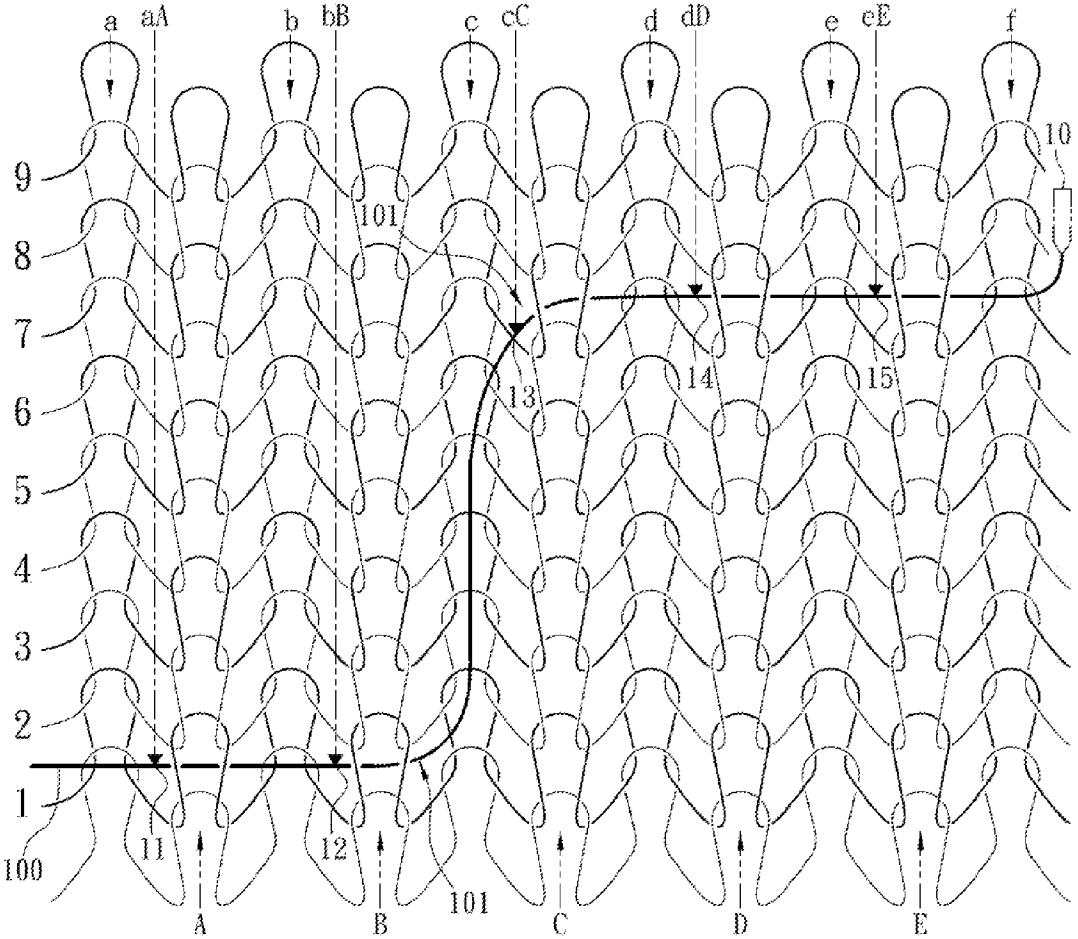
FIG. 9 is a planar schematic diagram of a double-sided fabric knit according to FIG. 8 of the present invention.

FIG. 8 and FIG. 9 show a diagram of partial knitting processes according to a fourth preferred embodiment of the present invention, and a planar schematic diagram of a double-sided fabric knit according to the diagram of partial knitting processes, respectively. Referring to FIG. 8 and FIG. 9, it is clearly seen that, the front needle bed includes a plurality of front knitting needles A to E, the back needle bed includes a plurality of back knitting needles a to f at corresponding position staggered from the plurality of front knitting needles A to E, and the loop presser bed is above the front needle bed or the back needle bed, and includes corresponding right-directed knitting pressing pieces aA, bB, cC, dD and eE and left-directed knitting pressing pieces Ef, De, Cd, Bc and Ab alternately arranged in gaps of the plurality of front knitting needles A to E and the plurality of back knitting needles a to f, respectively. The double-sided fabric includes a continuous linear material 100 that is pressed by the right-directed knitting pressing pieces aA, bB, cC, dD and eE and thus embedded into the double-sided fabric. To better describe the fourth preferred embodiment of the present invention, when the flat bed knitting machine applied in the present invention starts knitting according to the carriage operation direction 30 to the left side as shown in FIG. 8, the front knitting needles A to E and the back knitting needles a to f stitch to form loops as the knitting process 1 shown. After the operation of the knitting process 2 is performed along the carriage operation direction 30 to the right side, as the yarn feeder 10 progresses to before the front knitting needle A, the right-directed knitting pressing piece aA immediately presses a first pressing point 11 of the continuous linear material 100 downwards, such that the continuous linear material 100 is allowed to be embedded into the double-sided fabric as the yarn feeder 10 progresses to the back knitting needle b to form a loop group. When the yarn feeder 10 continues progressing to before the front knitting needle B, the right-directed knitting pressing piece bB immediately presses a second pressing point 12 of the continuous linear material 100 downwards, such that the continuous linear material 100 is allowed to be also embedded into double-sided fabric as the yarn feeder 10 progresses to the back knitting needle c to form a loop group. After the carriage operation direction 30 again moves to the left side, the yarn feeder 10 is located above the back knitting needle c at this point, and is lifted to set this position as a starting position for the next yarn feeding. Correspondingly, the front knitting needles A to E and the back knitting needles a to f stitch to form loops as the knitting process 3 shown. After the carriage operation direction 30 again moves to the right side, the yarn feeder 10 is still located above the back knitting needle c at this point, and is lifted to set this position as a starting position for the next yarn feeding. Correspondingly, the front knitting needles A to E and the back knitting needles a to f stitch to form loops as the knitting process 4 shown. After the carriage operation direction 30 again moves to the left side, the yarn feeder 10 is also located above the back knitting needle c at this point, and is lifted to set this position as a starting position for the next yarn feeding. Correspondingly, the front knitting needles A to E and the back knitting needles a to f stitch to form loops as the knitting process 5 shown. After the carriage operation direction 30 again moves to the right side, the yarn feeder 10 is similarly located above the back knitting needle c at this point, and is lifted to set this position as a starting position for the next yarn feeding. Correspondingly, the front knitting needles A to E and the back knitting needles a to f stitch to form loops as the knitting process 6 shown. After the carriage operation direction 30 again moves to the left side, the yarn feeder 10 is still located above the back knitting needle c, and is lifted to set this position as a starting position for the next yarn feeding. Correspondingly, the front knitting needles A to E and the back knitting needles a to f stitch to form loops as the knitting process 7 shown. After the operation of the knitting process 8 is performed along the carriage operation direction 30 again to the right side, as the yarn feeder 10 progresses to before the front knitting needle C, the right-directed knitting pressing piece cC immediately presses a third pressing point 13 of the continuous linear material 100 downwards, such that the continuous linear material 100 is allowed to be embedded into the double-sided fabric as the yarn feeder 10 progresses to the back knitting needle d to form a loop grou. At this point, the level drop in the continuous linear material 100 forms two curved portions 101. Similarly, when the carriage operation direction 30 continues moving to the right side and the yarn feeder 10 progresses to before the front knitting needle D, the right-directed knitting pressing piece dD immediately presses a fourth pressing point 14 of the continuous linear material 100 downwards, such that the continuous linear material 100 is allowed to be embedded into the double-sided fabric as the yarn feeder 10 progresses to the back knitting needle e to form a loop group. Further, when the carriage operation direction 30 continues moving to the right side and the yarn feeder 10 progresses to before the front knitting needle E, the right-directed knitting pressing piece eE immediately presses a fifth pressing point 15 of the continuous linear material 100 downwards, such that the continuous linear material 100 is allowed to be embedded into the double-sided fabric as the yarn feeder 10 progresses to the back knitting needle f to form a loop group. Finally, after the carriage operation direction 30 again moves to the left side, the yarn feeder 10 is located above the back knitting needle f at this point, and is lifted. Correspondingly, the front knitting needles A to E and the back knitting needles a to f stitch to form loops as the waving process 9 shown. Thus, the double-sided fabric embedded with the continuous linear material and formed as a curved form in FIG. 9 of the present invention is manufactured.

Figure 10:
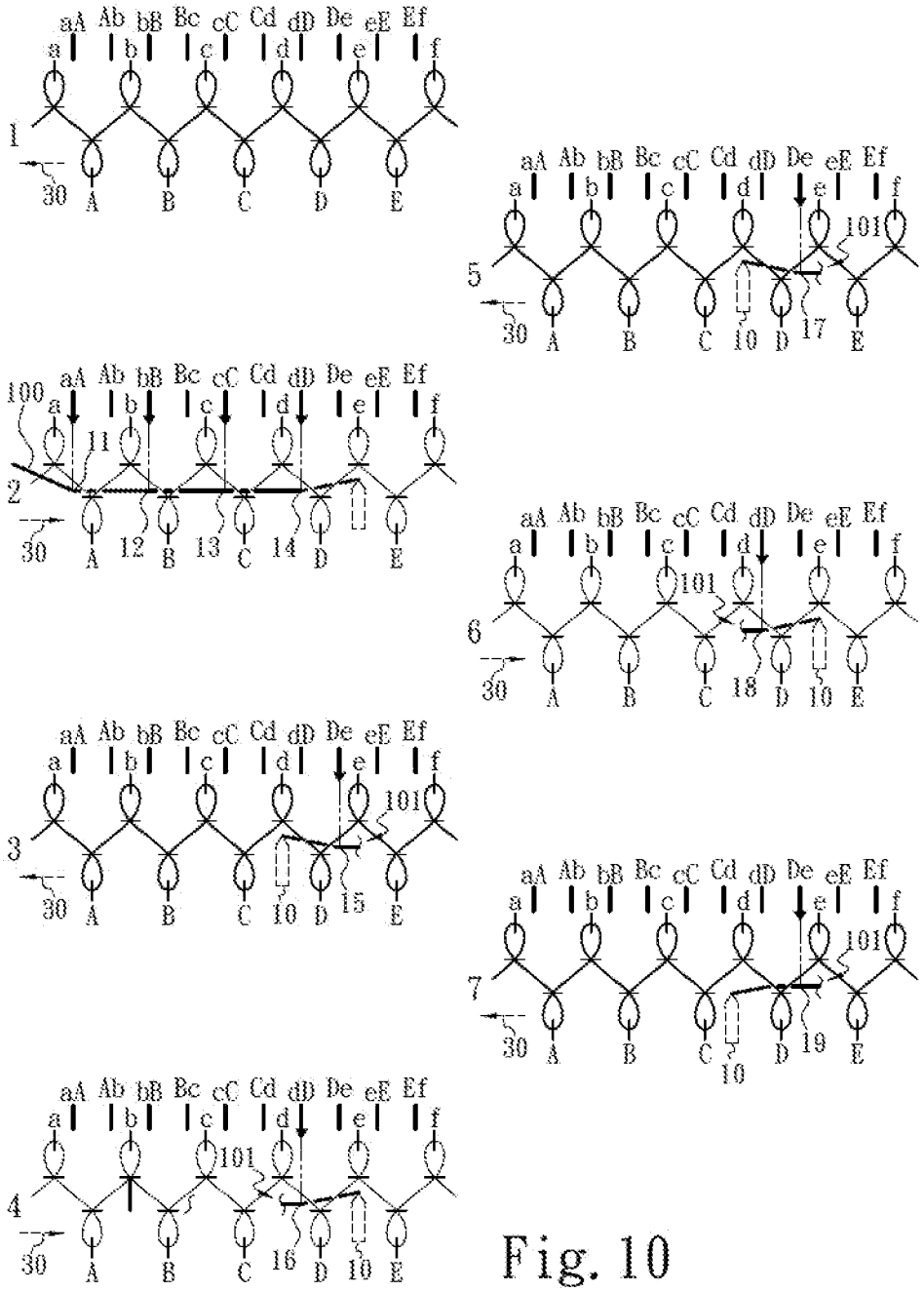
FIG. 10 shows a diagram of partial knitting processes according to a fifth preferred embodiment of the present invention.
Figure 11:
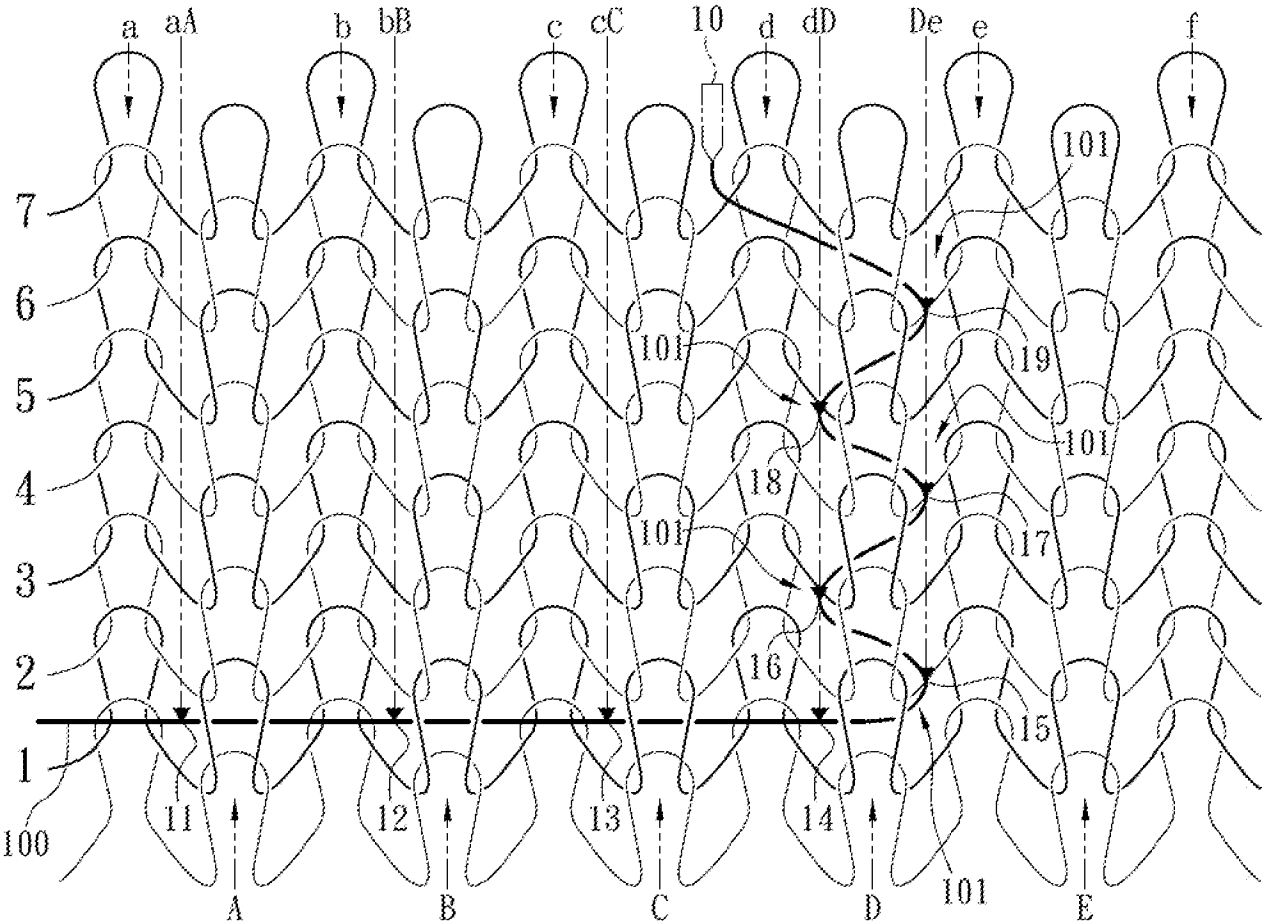
FIG. 11 is a planar schematic diagram of a double-sided fabric knit according to FIG. 10 of the present invention.

FIG. 10 and FIG. 11 show a diagram of partial knitting processes according to a fifth preferred embodiment of the present invention, and a planar schematic diagram of a double-sided fabric knit according to the diagram of partial knitting processes, respectively. Referring to FIG. 10 and FIG. 11, it is clearly seen that, the front needle bed includes a plurality of front knitting needles A to E, the back needle bed includes a plurality of back knitting needles a to f at corresponding position staggered from the plurality of front knitting needles A to E, and the loop presser bed is above the front needle bed or the back needle bed, and includes corresponding right-directed knitting pressing pieces aA, bB, cC, dD and eE and left-directed knitting pressing pieces Ef, De, Cd, Bc and Ab alternately arranged in gaps of the plurality of front knitting needles A to E and the plurality of back knitting needles a to f, respectively. The double-sided fabric includes a continuous linear material 100 that is pressed by the right-directed knitting pressing pieces aA, bB, cC and dD and the left-directed knitting pressing piece De and thus embedded into the double-sided fabric. To better describe the fifth preferred embodiment of the present invention, when the flat bed knitting machine applied in the present invention starts knitting according to the carriage operation direction 30 to the left side as shown in FIG. 10, the front knitting needles A to E and the back knitting needles a to f stitch to form loops as the knitting process 1 shown. After the operation of the knitting process 2 is performed along the carriage operation direction 30 to the right side, as the yarn feeder 10 progresses to before the front knitting needle A, the right-directed knitting pressing piece aA immediately presses a first pressing point 11 of the continuous linear material 100 downwards, such that the continuous linear material 100 is allowed to be embedded into the double-sided fabric as the yarn feeder 10 progresses to the back knitting needle b to form a loop group. When the yarn feeder 10 continues progressing to before the front knitting needle B, the right-directed knitting pressing piece bB immediately presses a second pressing point 12 of the continuous linear material 100 downwards, such that the continuous linear material 100 is allowed to be also embedded into double-sided fabric as the yarn feeder 10 progresses to the back knitting needle c to form a loop group. When the yarn feeder 10 continues progressing to before the front knitting needle C, the right-directed knitting pressing piece cC immediately presses a third pressing point 13 of the continuous linear material 100 downwards, such that the continuous linear material 100 is allowed to be also embedded into the double-sided fabric as the yarn feeder 10 progresses to the back knitting needle d to form a loop group. When the yarn feeder 10 further continues progressing to before the front knitting needle D, the right-directed knitting pressing piece dD immediately presses a fourth pressing point 14 of the continuous linear material 100 downwards, such that the continuous linear material 100 is allowed to be also embedded into double-sided fabric as the yarn feeder 10 progresses to the back knitting needle e to form a loop group. After the carriage operation direction 30 again moves to the left side, the yarn feeder 10 is located above the back knitting needle e at this point, and is lifted to set this position as a starting position for the next yarn feeding. When the carriage operation direction 30 continues moving to the left side and causes the yarn feeder 10 to feed in the continuous linear material 100, as the yarn feeder 10 continues progressing to the left side to before the front knitting needle D, the left-directed knitting pressing piece De immediately presses a fifth pressing point 15 of the continuous linear material 100 downwards, such that the continuous linear material 100 is allowed to be also embedded into the double-sided fabric as the yarn feeder 10 progresses to the back knitting needle d to form a loop group. At this point, the level drop in the continuous linear material 100 forms a curved portion 101 as the knitting process 3 shown. After the carriage operation direction 30 again moves to the right side, the yarn feeder 10 is located above the back knitting needle d at this point, and is lifted to set this position as a starting position for the next yarn feeding. When the carriage operation direction 30 continues moving to the right side and causes the yarn feeder 10 to feed in the continuous linear material 100, as the yarn feeder 10 progresses to the right side to before the front knitting needle D, the right-directed knitting pressing piece dD immediately presses a sixth pressing point 16 of the continuous linear material 100, such that the continuous linear material 100 is allowed to be embedded into the double-sided fabric as the yarn feeder 10 progresses to the back knitting needle e to form a loop group. At this point, the level drop in the continuous linear material 100 forms another curved portion 101, as shown in the knitting process 4. After the carriage operation direction 30 again moves to the left side, the yarn feeder 10 is located above the back knitting needle e at this point, and is lifted to set this position as a starting position for the next yarn feeding. When the carriage operation direction 30 continues moving to the left side and causes the yarn feeder 10 to feed in the continuous linear material 100, as the yarn feeder 10 progresses to the left side to before the front knitting needle D, the left-directed knitting pressing piece De immediately presses a seventh pressing point 17 of the continuous linear material 100 downwards, such that the continuous linear material 100 is allowed to be embedded into the double-sided fabric as the yarn feeder 10 progresses to the back knitting needle d to form a loop group. At this point, the level drop in the continuous linear material 100 forms another curved portion 101, as shown in the knitting process 5. After the carriage operation direction 30 again moves to the right side, the yarn feeder 10 is located above the back knitting needle d at this point, and is lifted to set this position as a starting position for the next yarn feeding. When the carriage operation direction 30 continues moving to the right side and causes the yarn feeder 10 to feed in the continuous linear material 100, as the yarn feeder 10 progresses to the right side to before the front knitting needle D, the right-directed knitting pressing piece dD immediately presses an eighth pressing point 18 of the continuous linear material 100, such that the continuous linear material 100 is allowed to be embedded into the double-sided fabric as the yarn feeder 10 progresses to the back knitting needle e to form a loop group. At this point, the level drop in the continuous linear material 100 forms another curved portion 101, as shown in the knitting process 6. After the carriage operation direction 30 again moves to the left side, the yarn feeder 10 is located above the back knitting needle e at this point, and is lifted to set this position as a starting position for the next yarn feeding. When the carriage operation direction 30 continues moving to the left side and causes the yarn feeder 10 to feed in the continuous linear material 100, as the yarn feeder 10 progresses to the left side to before the front knitting needle D, the left-directed knitting pressing piece De immediately presses a ninth pressing point 19 of the continuous linear material 100, such that the continuous linear material 100 is allowed to be embedded into the double-sided fabric as the yarn feeder 10 progresses to the back knitting needle d to form a loop group. At this point, the level drop in the continuous linear material 100 forms another curved portion 101, as shown in the knitting process 7. Thus, the double-sided fabric embedded with a continuous linear material and formed as a curved form in FIG. 11 of the present invention is manufactured.

Figure 12:
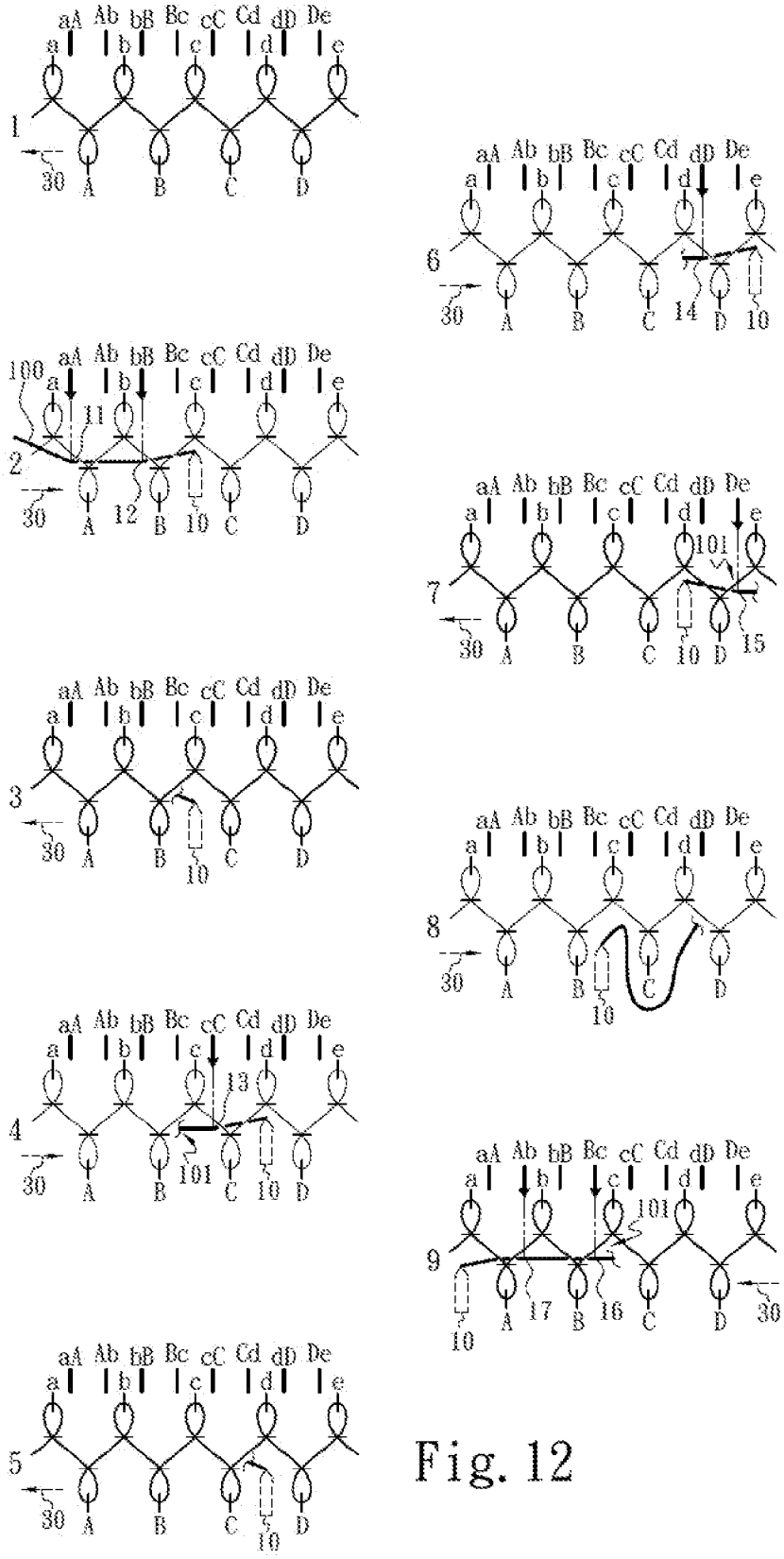
FIG. 12 shows a diagram of partial knitting processes according to a sixth preferred embodiment of the present invention.
Figure 13:
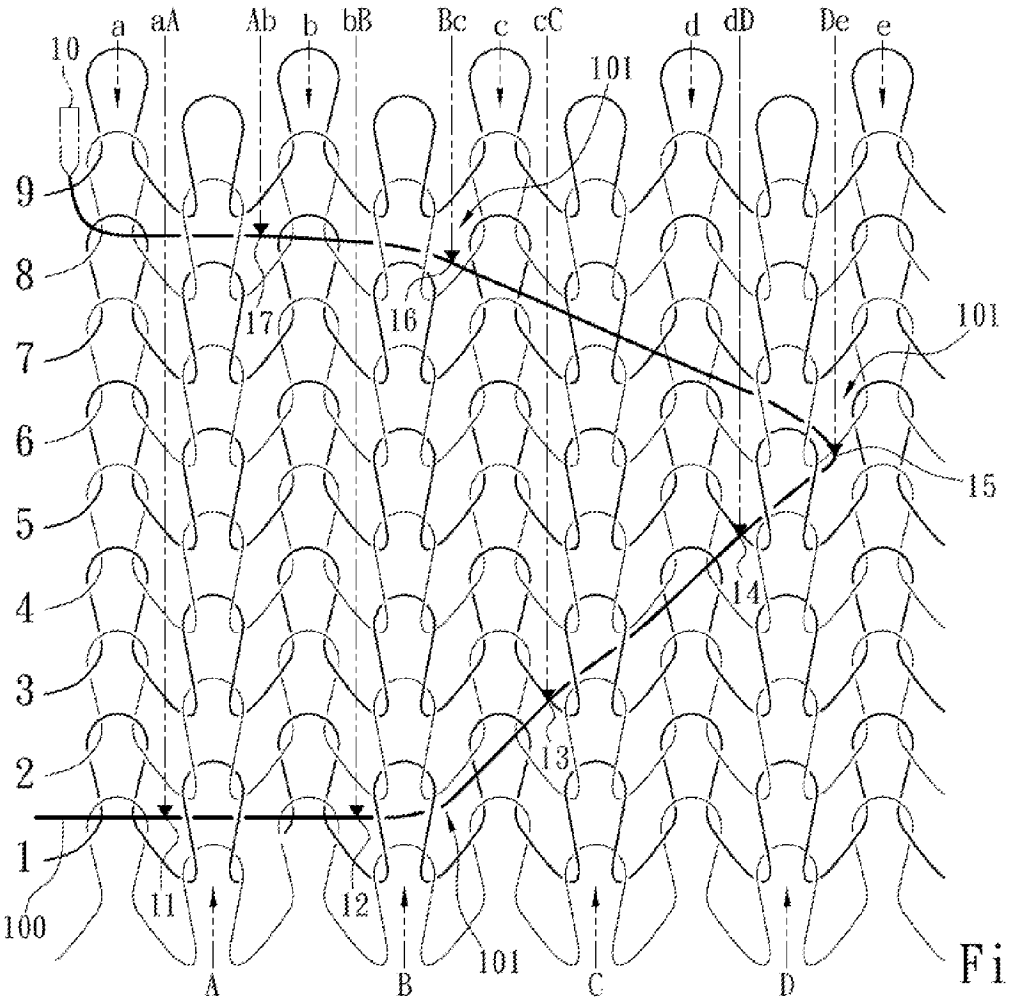
FIG. 13 is a planar schematic diagram of a double-sided fabric knit according to FIG. 12 of the present invention.

FIG. 12 and FIG. 13 show a diagram of partial knitting processes according to a sixth preferred embodiment of the present invention, and a planar schematic diagram of a double-sided fabric knit according to the diagram of partial knitting processes, respectively. Referring to FIG. 12 and FIG. 13, it is clearly seen that, the front needle bed includes a plurality of front knitting needles A to D, the back needle bed includes a plurality of back knitting needles a to e at corresponding position staggered from the plurality of front knitting needles A to D, and the loop presser bed is above the front needle bed or the back needle bed, and includes corresponding right-directed knitting pressing pieces aA, bB, cC and dD and left-directed knitting pressing pieces De, Cd, Bc and Ab alternately arranged in gaps of the plurality of front knitting needles A to D and the plurality of back knitting needles a to e, respectively. The double-sided fabric includes a continuous linear material 100 that is pressed by the right-directed knitting pressing pieces aA, bB, cC and dD and the left-directed knitting pressing pieces De, Bc and Ab and thus embedded into the double-sided fabric. To better describe the sixth preferred embodiment of the present invention, when the flat bed knitting machine applied in the present invention starts knitting according to the carriage operation direction 30 to the left side as shown in FIG. 12, the front knitting needles A to D and the back knitting needles a to e stitch to form loops as the knitting process 1 shown. After the operation of the knitting process 2 is performed along the carriage operation direction 30 to the right side, as the yarn feeder 10 progresses to before the front knitting needle A, the right-directed knitting pressing piece aA immediately presses a first pressing point 11 of the continuous linear material 100 downwards, such that the continuous linear material 100 is allowed to be embedded into the double-sided fabric as the yarn feeder 10 progresses to the back knitting needle b to form a loop group. When the yarn feeder 10 continues progressing to before the front knitting needle B, the right-directed knitting pressing piece bB immediately presses a second pressing point 12 of the continuous linear material 100 downwards, such that the continuous linear material 100 is allowed to be also embedded into double-sided fabric as the yarn feeder 10 progresses to the back knitting needle c to form a loop group. After the carriage operation direction 30 again moves the left side, the yarn feeder 10 is located above the back knitting needle c at this point, and is lifted to set this position as a starting position for the next yarn feeding. Correspondingly, the front knitting needles A to D and the back knitting needles a to e stitch to form loops as the knitting process 3 shown. After the operation of the knitting process 4 is performed along the carriage operation direction 30, as the yarn feeder 10 progresses to before the front knitting needle C, the right-directed knitting pressing piece cC immediately presses a third pressing point 13 of the continuous linear material 100 downwards, such that the continuous linear material 100 is allowed to be also embedded into the double-sided fabric as the yarn feeder 10 progresses to the back knitting needle d to form a loop group. At this point, the level drop in the continuous linear material 100 forms a curved portion 101. Similarly, after the carriage operation direction 30 again moves to the left side, the yarn feeder 10 is located above the back knitting needle d at this point, and is lifted to set this position as a starting position for the next yarn feeding. Correspondingly, the front knitting needles A to D and the back knitting needles a to e stitch to form loops as the knitting process 5 shown. After the operation of the knitting process 6 is performed along the carriage operation direction 30 to the right side, as the yarn feeder 10 progresses to before the front knitting needle D, the right-directed knitting pressing piece dD immediately presses a fourth pressing point 14 of the continuous linear material 100, such that the continuous linear material 100 is allowed to be embedded into the double-sided fabric as the yarn feeder 10 progresses to the back knitting needle e to form a loop group. Further, after the carriage operation direction 30 again moves to the left side, the yarn feeder 10 is located above the back knitting needle e at this point, and is lifted to set this position as a starting position for the next yarn feeding. Because the yarn feeder 10 is located above the back knitting needle e at this point and is lifted to set this position as a starting position for the next yarn feeding, when the carriage operation direction 30 again moves to the left side and causes the yarn feeder 10 to feed in the continuous linear material 100, as the yarn feeder 10 progresses to the left side to before the front knitting needle D, the left-directed knitting pressing piece De immediately presses a fifth pressing point 15 of the continuous linear material 100 downwards, such that the continuous linear material 100 is allowed to be embedded into the double-sided fabric as the yarn feeder 10 progresses to the back knitting needle d to form a loop group. At this point, the level drop in the continuous linear material 100 forms a curved portion 101, as shown in the knitting process 7. When the carriage operation direction 30 again moves to the right side, the yarn feeder 10 is located above the back knitting needle d at this point, and is lifted to set this position as a starting position for the next feeding. At this point, the yarn feeder 10 feeds in the continuous linear material 100, and the starting position of the yarn feeder 10 is relocated to above the back knitting needle c. Correspondingly, the front knitting needles A to D and the back knitting needles a to e stitch to form loops as the knitting process 8 shown. When the carriage operation direction 30 again moves to the left side and causes the yarn feeder 10 to feed in the continuous linear material 100, as the yarn feeder 10 progresses to the left to before the front knitting needle B, the left-directed knitting pressing piece Bc immediately presses a sixth pressing point 16 of the continuous linear material 100, such that the continuous linear material 100 is allowed to be embedded into the double-sided fabric as the yarn feeder 10 progresses to the back knitting needle b to form a loop group. At this point, the level drop in the continuous linear material 100 forms another curved portion 101, as shown in the knitting process 9. When carriage operation direction 30 continues moving to the left side and causes the yarn feeder 10 to feed in the continuous linear material 100, as the yarn feeder 10 progresses to the left side to before the front knitting needle A, the left-directed knitting pressing piece Ab immediately presses a seventh pressing point 17 of the continuous linear material 100 downwards, such that the continuous linear material 100 is allowed to be embedded into the double-sided fabric as the yarn feeder 10 progresses to the back knitting needle a to form a loop group. Thus, the double-sided fabric embedded with a continuous linear material and formed as a curved form shown in FIG. 13 of the present invention is manufactured.

Figure 14:
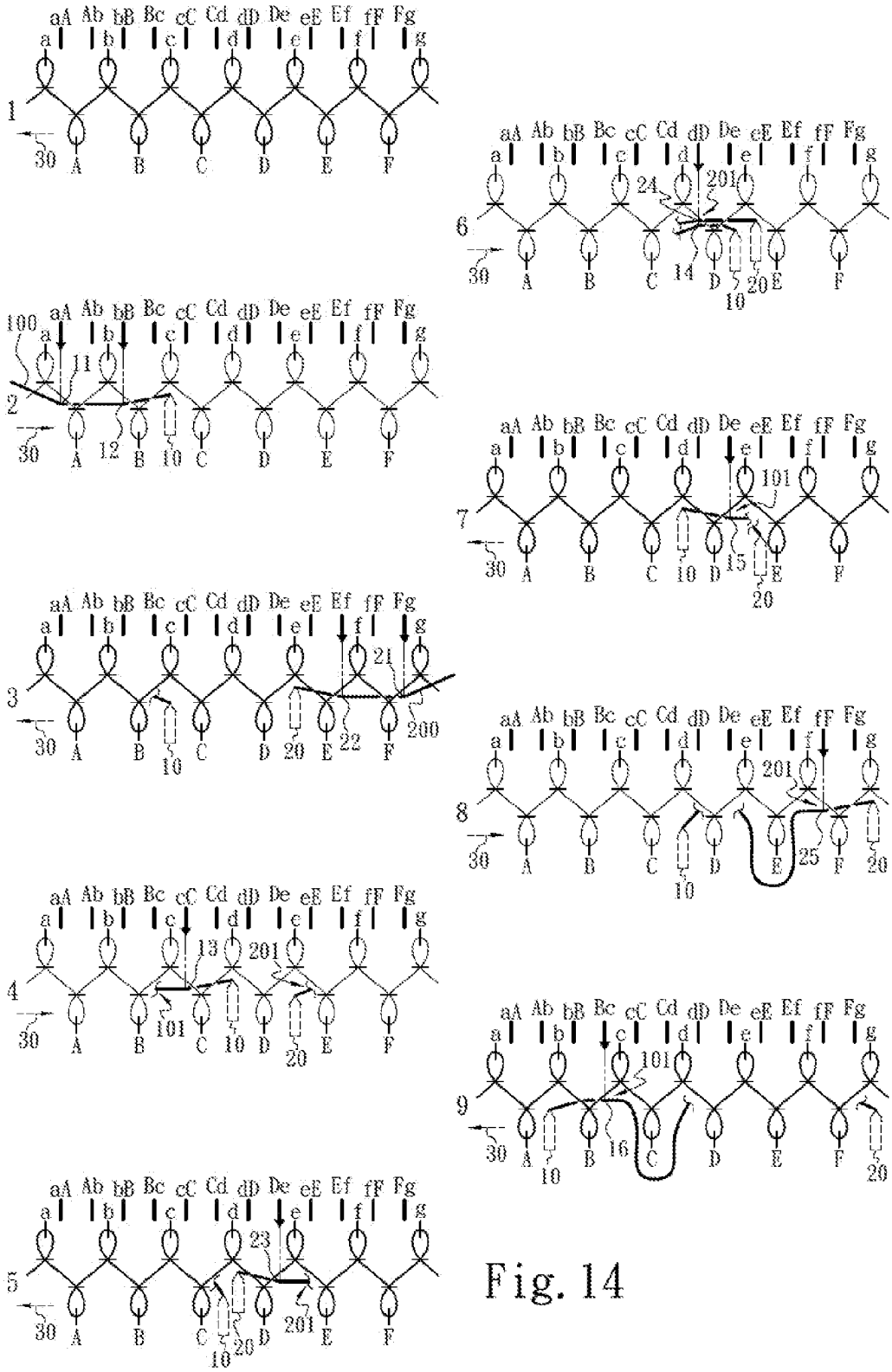
FIG. 14 shows a diagram of partial knitting processes according to a seventh preferred embodiment of the present invention.
Figure 15:
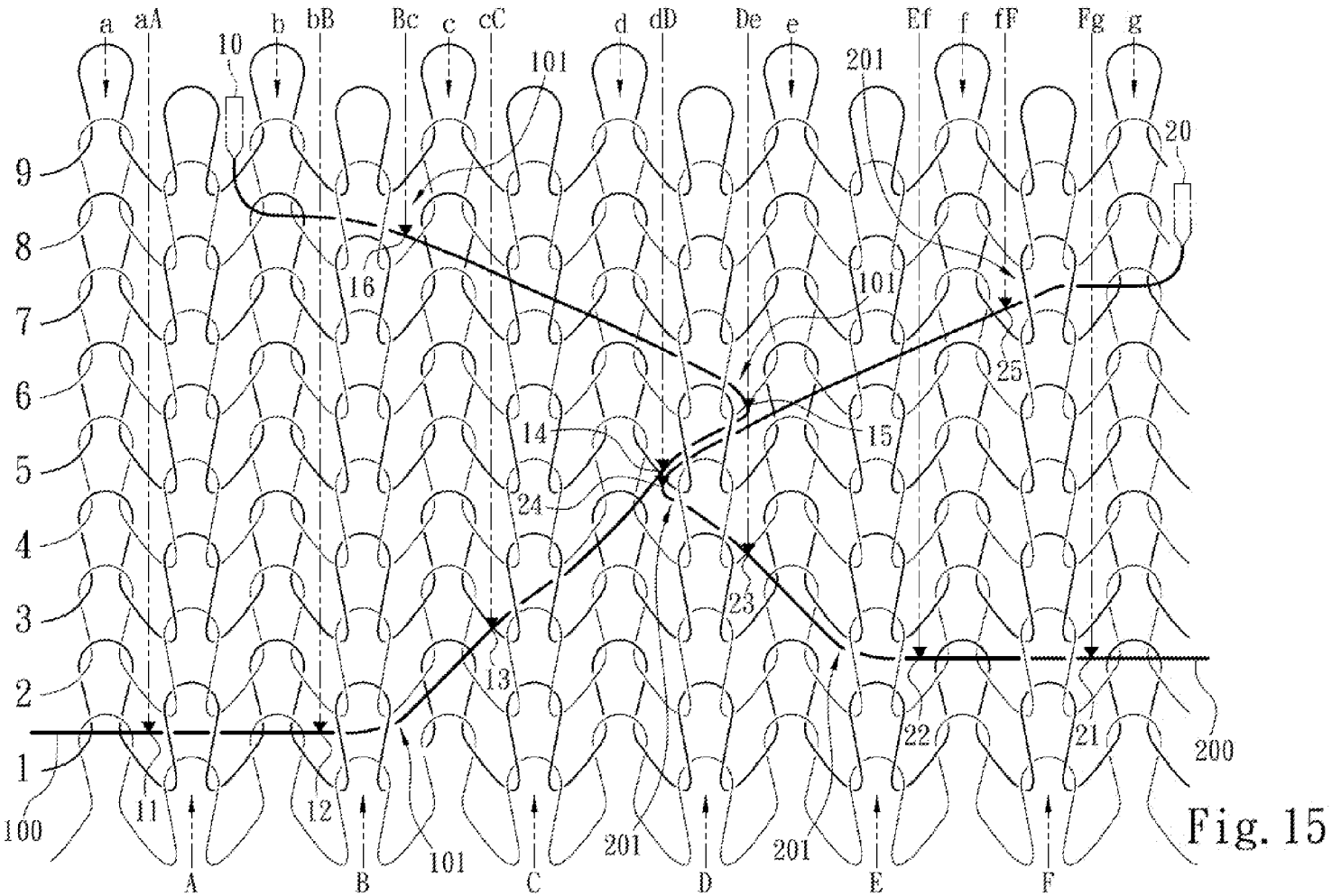
FIG. 15 is a planar schematic diagram of a double-sided fabric knit according to FIG. 14 of the present invention.

FIG. 14 and FIG. 15 show a diagram of partial knitting processes according to a seventh preferred embodiment of the present invention, and a planar schematic diagram of a double-sided fabric knit according to the diagram of partial knitting processes, respectively. Referring to FIG. 14 and FIG. 15, it is clearly seen that, the front needle bed includes a plurality of front knitting needles A to F, the back needle bed includes a plurality of back knitting needles a to g at corresponding position staggered from the plurality of front knitting needles A to F, and the loop presser bed is above the front needle bed or the back needle bed, and includes corresponding right-directed knitting pressing pieces aA, bB, cC, dD, eE and fi and left-directed knitting pressing pieces Fg, Ef, De, Cd, Bc and Ab alternately arranged in gaps of the plurality of front knitting needles A to F and the plurality of back knitting needles a to g, respectively. The double-sided fabric includes a continuous linear material 100 that is pressed by the right-directed knitting pressing pieces aA, bB, cC and dD and the left-directed knitting pressing pieces De and Bc and thus embedded into the double-sided fabric, and a continuous linear material 200 pressed by the left-directed knitting pressing pieces Fg, Ef and De and the right-directed knitting pressing pieces dD and fi and thus embedded into the double-sided fabric. To better describe the seventh preferred embodiment of the present invention, when the flat bed knitting machine applied in the present invention starts knitting according to the carriage operation direction 30 to the left side as shown in FIG. 14, the front knitting needles A to F and the back knitting needles a to g stitch to form loops as the knitting process 1 shown. After the operation of the knitting process 2 is performed along the carriage operation direction 30 to the right side, as the yarn feeder 10 progresses to before the front knitting needle A, the right-directed knitting pressing piece aA immediately presses a first pressing point 11 of the continuous linear material 100 downwards, such that the continuous linear material 100 is allowed to be embedded into the double-sided fabric as the yarn feeder 10 progresses to the back knitting needle b to form a loop group. When the yarn feeder 10 continues progressing to before the front knitting needle B, the right-directed knitting pressing piece bB immediately presses a second pressing point 12 of the continuous linear material 100, such that the continuous linear material 100 is allowed to be also embedded into double-sided fabric as the yarn feeder 10 progresses to the back knitting needle c to form a loop group. After the carriage operation direction 30 again moves to the left side, the yarn feeder 10 is located above the back knitting needle c at this point, and is lifted to set this position as a starting position for the next yarn feeding. Correspondingly, the front knitting needles A to F and the back knitting needles a to g stitch to form loops as the knitting process 3 shown. Meanwhile, another yarn feeder 20 is provided to feed the continuous linear material 200 from the back knitting needle g from the right side to the left side. When the yarn feeder 20 progresses to before the front knitting needle F, the left-directed knitting pressing piece Fg immediately presses a first pressing point 21 of the continuous linear material 200, such that the continuous linear material 200 is allowed to be embedded into the double-sided fabric as the yarn feeder 20 progresses to the back knitting needle f to form a loop group. When the yarn feeder 20 continues progressing to before the front knitting needle E, the left-directed knitting pressing piece Ef immediately presses a second pressing point 22 of the continuous linear material 200 downwards, such that the continuous linear material 200 is allowed to be also embedded into the double-sided fabric as the yarn feeder 20 progresses to the back knitting needle e to form a loop group. After the operation of the knitting process 4 is performed along the carriage operation direction 30 to the left side, as the yarn feeder 10 progresses to before the front knitting needle C, the right-directed knitting pressing piece cC immediately presses a third pressing point 13 of the continuous linear material 100 downwards, such that the continuous linear material 100 is allowed to be embedded into the double-sided fabric as the yarn feeder 10 progresses to the back knitting needle d to form a loop group. At this point, the level drop in the continuous linear material 100 forms a curved portion 101. Further, at this point, the yarn feeder 20 is located above the back knitting needle, and is lifted to set this position as a starting position for the next yarn feeding. Similarly, when the carriage operation direction 30 again moves to the left side, the yarn feeder 10 is located above the back knitting needle d at this point, and is lifted to set this position as a starting position for the next yarn feeding. Correspondingly, the front knitting needles A to F and the back knitting needles a to g stitch to form loops as the knitting process 5 shown. At this point, as the yarn feeder 20 progresses to before the front knitting needle D, the left-directed knitting pressing piece De immediately presses a third pressing point 23 of the continuous linear material 200 downwards, such that the continuous linear material 200 is allowed to be embedded into the double-sided fabric as the yarn feeder 20 progresses to the back knitting needle d to form a loop group. At this point, the level drop in the continuous linear material 200 forms a curved portion 201. After the operation of the knitting process 6 is performed along the carriage operation direction 30 to the right side, as the yarn feeder 10 progresses to before the front knitting needle D, the right-directed knitting pressing piece dD immediately presses a fourth pressing point 14 of the continuous linear material 100, such that the continuous linear material 100 is allowed to be embedded into the double-sided fabric as the yarn feeder 10 progresses to the back knitting needle e to form a loop group. At this point, the yarn feeder 20 is located above the back knitting needle d, and is lifted to set this position as a starting position for the next yarn feeding. When the yarn feeder 20 again starts feeding the continuous linear material 200 and progresses to before the front knitting needle D, the right-directed knitting pressing piece dD at the same time presses a fourth pressing point 24 of the continuous linear material 200 downwards, such that the continuous linear material 200 is allowed to be embedded into the double-sided fabric as the yarn feeder 20 progresses to the back knitting needle e to form a loop group. Further, after the carriage operation direction 30 again moves to the left side, the yarn feeder 10 is located above the back knitting needle e at this point, and is lifted to set this position as a starting position for the next yarn feeding. Because the yarn feeder 10 is located above the back knitting needle e at this point and is lifted to set this position as a starting position for the next yarn feeding, when the carriage operation direction 30 continues moving to the left side and causes the yarn feeder 10 to feed in the continuous linear material 100, as the yarn feeder 10 progresses to the left side to before the front knitting needle D, the left-directed knitting pressing piece De immediately presses a fifth pressing point 15 of the continuous linear material 100 downwards, such that the continuous linear material 100 is allowed to be embedded into the double-sided fabric as the yarn feeder 10 progresses to the back knitting needle d to form a loop group. At this point, the level drop in the continuous linear material 100 forms a curved portion 101, as shown in the knitting process 7. The yarn feeder 20 is located above the back knitting needle e at this point, and is lifted to set this position as a starting position for the next yarn feeding. After the carriage operation direction 30 again moves to the right side, because the yarn feeder 10 is located above the back knitting needle d at this point and is lifted to set this position as a starting position for the next yarn feeding, the yarn feeder 10 feeds in the continuous linear material 100 at this point, and the starting position of the yarn feeder 10 is relocated to above the back knitting needle c. Correspondingly, the front knitting needles A to F and the back knitting needles a to g stitch to form loops as the knitting process 8 shown. Because the yarn feeder 20 is located above the back knitting needle e at this point and is lifted to set this position as a starting position for the next yarn feeding, when the carriage operation direction 30 again moves to the right side and causes the yarn feeder 20 to feed in the continuous linear material 200, as the yarn feeder 20 progresses to the right side to before the front knitting needle F, the right-directed knitting pressing piece fi immediately presses a fifth pressing point 15 of the continuous linear material 200 downwards, such that the continuous linear material 200 is allowed to be embedded into the double-sided fabric as the yarn feeder 20 progresses to the back knitting needle g to form a loop group. When the carriage operation direction 30 again moves to the left side and causes the yarn feeder 10 to feed in the continuous linear material 100, as the yarn feeder 10 progresses to the left to before the front knitting needle B, the left-directed knitting pressing piece Bc immediately presses a sixth pressing point 16 of the continuous linear material 100 downwards, such that the continuous linear material 100 is allowed to be embedded into the double-sided fabric as the yarn feeder 10 progresses to the back knitting needle b to form a loop group. At this point, the level drop in the continuous linear material 100 forms another curved portion 101, as shown in the knitting process 9. When the carriage operation direction 30 continues moving to the left side and causes the yarn feeder 10 to feed in the continuous linear material 100, as the yarn feeder 10 progresses to the left side to before the front knitting needle A, the left-directed knitting pressing piece Ab immediately presses a seventh pressing point 17 of the continuous linear material 100 downwards, such that the continuous linear material 100 is allowed to be embedded into the double-sided fabric as the yarn feeder 10 progresses to the back knitting needle a to form a loop group. Thus, the double-sided fabric embedded with a continuous linear material and formed as a curved form shown in FIG. 15 of the present invention is manufactured.

What is claimed is:

1. A double-sided fabric embedded with a continuous linear material and formed as a curved form, the double-sided fabric knit by a flat bed knitting machine comprising a front needle bed, a back needle bed and a loop presser bed, the front needle bed comprising a plurality of front knitting needles, the back needle bed comprising a plurality of back knitting needles at corresponding positions staggered from the plurality of front knitting needles, the loop presser bed disposed above the front needle bed or the back needle bed, and comprising a plurality of right-directed knitting pressing pieces and a plurality of left-directed knitting pressing pieces alternately arranged in gaps of the plurality of front knitting needles and the plurality of back knitting needles, respectively, the double-sided fabric being characterized that:

the double-sided fabric comprises a continuous linear material pressed by the plurality of right-directed knitting pressing pieces and/or the plurality of left-directed knitting pressing pieces and thus embedded into the double-sided fabric, the continuous linear material is embedded into the double-sided fabric to form a plurality of loop groups, each of the loop groups comprises loops stitched and formed by one of the front knitting needles and two of the back knitting needles at two sides of the front knitting needle in a knitting process and the front knitting needle and the two back knitting needles in a next knitting process, and at least two of the plurality of loops groups are located in different knitting processes to cause a level drop in the continuous linear material to form at least one curved portion.

2. The double-sided fabric embedded with a continuous linear material and formed as a curved form of claim 1, being characterized that, the continuous linear material is embedded from the front needle bed towards the double-sided fabric, and is withdrawn from the front needle bed and departs the double-sided fabric.

3. The double-sided fabric embedded with a continuous linear material and formed as a curved form of claim 1, being characterized that, the continuous linear material is embedded from the front needle bed towards the double-sided fabric, and is withdrawn from the back needle bed and departs the double-sided fabric.

4. The double-sided fabric embedded with a continuous linear material and formed as a curved form of claim 1, being characterized that, the continuous linear material is embedded from the back needle bed towards the double-sided fabric, and is withdrawn from the back needle bed and departs the double-sided fabric.

5. The double-sided fabric embedded with a continuous linear material and formed as a curved form of claim 1, being characterized that, the continuous linear material is embedded from the back needle bed towards the double-sided fabric, and is withdrawn from the front needle bed and departs the double-sided fabric.

6. The double-sided fabric embedded with a continuous linear material and formed as a curved form of claim 1, being characterized that, the continuous linear material is at least one selected from the group consisting of a conductive wire material and a non-conductive wire material.

7. The double-sided fabric embedded with a continuous linear material and formed as a curved form of claim 2, being characterized that, the continuous linear material is at least one selected from the group consisting of a conductive wire material and a non-conductive wire material.

8. The double-sided fabric embedded with a continuous linear material and formed as a curved form of claim 3, being characterized that, the continuous linear material is at least one selected from the group consisting of a conductive wire material and a non-conductive wire material.

9. The double-sided fabric embedded with a continuous linear material and formed as a curved form of claim 4, being characterized that, the continuous linear material is at least one selected from the group consisting of a conductive wire material and a non-conductive wire material.

10. The double-sided fabric embedded with a continuous linear material and formed as a curved form of claim 5, being characterized that, the continuous linear material is at least one selected from the group consisting of a conductive wire material and a non-conductive wire material.

* * * * *